US008823693B2

(12) United States Patent
Ono

(10) Patent No.: US 8,823,693 B2
(45) Date of Patent: Sep. 2, 2014

(54) DISPLAY DEVICE AND METHOD OF CONTROLLING THE SAME

(75) Inventor: Shinya Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 53 days.

(21) Appl. No.: 13/484,402

(22) Filed: May 31, 2012

(65) Prior Publication Data

US 2012/0242643 A1 Sep. 27, 2012

Related U.S. Application Data

(63) Continuation of application No. PCT/JP2009/006717, filed on Dec. 9, 2009.

(51) Int. Cl.
*G09G 3/32* (2006.01)

(52) U.S. Cl.
CPC ..... *G09G 3/3233* (2013.01); *G09G 3/3291* (2013.01); *G09G 2310/0262* (2013.01); *G09G 2310/061* (2013.01); *G09G 2320/0257* (2013.01); *G09G 2300/0819* (2013.01)
USPC ..... 345/211

(58) Field of Classification Search
CPC ..... G09G 3/325
USPC ..... 250/214.1; 345/210, 211, 212
See application file for complete search history.

(56) References Cited

U.S. PATENT DOCUMENTS

| | | | | |
|---|---|---|---|---|
| 6,611,107 | B2 | 8/2003 | Mikami et al. | |
| 7,075,238 | B2 | 7/2006 | Lee et al. | |
| 7,205,965 | B2 | 4/2007 | Mikami et al. | |
| 7,329,849 | B2 | 2/2008 | Kasai | |
| 7,750,875 | B2 | 7/2010 | Kim et al. | |
| 7,907,137 | B2 * | 3/2011 | Shirasaki et al. | 345/212 |
| 7,944,416 | B2 | 5/2011 | Ono et al. | |
| 8,581,485 | B2 | 11/2013 | Ono et al. | |
| 2003/0111966 | A1 | 6/2003 | Mikami et al. | |

(Continued)

FOREIGN PATENT DOCUMENTS

| | | |
|---|---|---|
| CN | 1856195 | 11/2006 |
| CN | 1957388 | 5/2007 |

(Continued)

OTHER PUBLICATIONS

Extended European Search Report from E.P.O. in European Patent Application No. 09852012.5, mail date is Aug. 8, 2012.

(Continued)

*Primary Examiner* — Dwayne Bost
*Assistant Examiner* — Sepehr Azari
(74) *Attorney, Agent, or Firm* — Greenblum & Bernstein, P.L.C.

(57) ABSTRACT

The display device according to the present invention includes: a luminescence element, a capacitor, a drive transistor, a reference power source line, a first switching transistor, a data line, a second switching transistor which switches between conduction and non-conduction between the data line and a second electrode of the capacitor, a reset line, a scanning line, and a scanning line drive circuit. The scanning line drive circuit turns ON the first switching transistor so that reference voltage is supplied to the gate electrode of the drive transistor, and turns ON the second switching transistor in a period in which the first switching element is ON so that a predetermined reset voltage is applied from the data line to a connection point between a first electrode of the luminescence element and a source electrode of the drive transistor.

20 Claims, 21 Drawing Sheets

(56) References Cited

U.S. PATENT DOCUMENTS

| | | | | |
|---|---|---|---|---|
| 2004/0021620 | A1 | 2/2004 | Mikami et al. | |
| 2006/0007070 | A1 | 1/2006 | Shih | |
| 2006/0044235 | A1 | 3/2006 | Lee et al. | |
| 2006/0231740 | A1 | 10/2006 | Kasai | |
| 2007/0046592 | A1 | 3/2007 | Ono et al. | |
| 2007/0296672 | A1 | 12/2007 | Kim et al. | |
| 2009/0278833 | A1* | 11/2009 | Tomida et al. | 345/211 |
| 2010/0079430 | A1* | 4/2010 | Yamashita et al. | 345/210 |
| 2010/0245331 | A1 | 9/2010 | Shirouzu et al. | |
| 2010/0253609 | A1 | 10/2010 | Ono et al. | |
| 2010/0253715 | A1 | 10/2010 | Odawara et al. | |
| 2010/0259531 | A1 | 10/2010 | Ono | |
| 2011/0032232 | A1 | 2/2011 | Smith | |
| 2011/0164024 | A1 | 7/2011 | Ono | |
| 2011/0285760 | A1 | 11/2011 | Ono | |
| 2011/0310083 | A1* | 12/2011 | Ikeda | 345/212 |

FOREIGN PATENT DOCUMENTS

| | | |
|---|---|---|
| JP | 2003-186438 | 7/2003 |
| JP | 2005-346073 | 12/2005 |
| JP | 2006-72303 | 3/2006 |
| JP | 2006-301159 | 11/2006 |
| JP | 2008-3542 | 1/2008 |
| WO | 2005/114629 | 12/2005 |
| WO | 2009/044120 | 4/2009 |

OTHER PUBLICATIONS

Shirasaki, T. et al., "Solution for Large-Area Full-Color OLED Television—Light Emitting Polymer and a-Si TFT Technologies", IDW, AMD3/OLED5—1 Invited, London UK, XP007013688, pp. 275-278 (Jan. 1, 2004).

Search report from International Application No. PCT/JP2009/006717, mail date is Jan. 12, 2010.

Office Action with Search Report from the Patent Office of the People's Republic of China in Chinese Patent Application 200980157964.4, dated May 27, 2014, together with an English language translation of the Search Report.

* cited by examiner

DISPLAY DEVICE AND METHOD OF CONTROLLING THE SAME

CROSS REFERENCE TO RELATED APPLICATION

This is a continuation application of PCT application No. PCT/JP2009/006717 filed on Dec. 9, 2009, designating the United States of America.

BACKGROUND OF THE INVENTION (1) Field of the Invention

The present invention relates to display devices and to methods of controlling the same, and particularly relates to a display device using a current-driven luminescence element and to a method of controlling the same.

(2) Description of the Related Art

Image display devices using organic electroluminescence (EL) elements are well-known as image display devices using current-driven luminescence elements. An organic EL display device using such organic EL elements does not require backlights which are needed in a liquid crystal display device, and is thus best-suited for increasing device thinness.

In an organic EL display device using organic EL elements, the organic EL elements included in pixels are arranged in a matrix, and each of the organic EL elements can be caused to produce luminescence by controlling a drive element which supplies current to the organic EL element.

Specifically, a switching thin film transistor (TFT) is provided in each crosspoint between scanning lines and data lines, the switching TFT is connected to a capacitor, the switching TFT is turned ON through a selected scanning line so as to input a data voltage corresponding to a luminescence production luminance, from a signal line to the capacitor. Furthermore, the capacitor is connected to a gate electrode of the drive element. In other words, the data voltage is applied to the gate electrode of the drive element.

With this configuration, the drive element supplies current to the organic EL element even in a period in which the switching TFT is not selected. A display device in which the organic EL element is driven by such a driving element is called an active-matrix organic EL display device.

SUMMARY OF THE INVENTION

The present invention has as an object to provide a display device which can ensure display luminance and prevent the occurrence of afterimage, and a method of controlling the same.

In order to achieve the aforementioned object, the display device according to an aspect of the present invention includes: a luminescence element including a first electrode and a second electrode; a capacitor which holds a voltage; a drive element which includes a gate electrode connected to a first electrode of the capacitor, and a source electrode connected to the first electrode of the luminescence element, and which supplies a drain current corresponding to the voltage held in the capacitor to the luminescence element so that the luminescence element produces luminescence; a power source line for supplying a reference voltage which defines a voltage value of the gate electrode of the drive element for placing the luminescence element in a OFF state; a first switching element which supplies the reference voltage to the gate electrode of the drive element; a data line for supplying a signal voltage and a predetermined reset voltage; a second switching element which includes one of terminals connected to the data line, and an other of the terminals connected to a second electrode of the capacitor, and which switches between conduction and non-conduction between the data line and the second electrode of the capacitor; and a drive circuit which controls the first switching element and the second switching element, wherein the drive circuit: turns ON the first switching element so that the reference voltage is supplied to the gate electrode of the drive element and the luminescence element is placed in the OFF state, and turns ON the second switching element in a period in which the first switching element is ON so that the predetermined reset voltage is applied from the data line to a connection point between the first electrode of the luminescence element and the source electrode of the drive element.

According to the display device and the method of controlling the same according to the present invention, the source electrode of the drive element is instantaneously reset to a predetermined reset voltage. Specifically, in the period in which there is no connection between the source and drain of the drive element, the predetermined reset voltage is applied to the connection point between the first electrode of the luminescence element and the source electrode of the drive element, thereby forcibly resetting the potentials of the source electrode of the drive element and the first electrode of the luminescence element. Therefore, since the gate-source voltage of the drive element can be reset to the difference voltage between the reference voltage and the predetermined reset voltage, it is possible to prevent the occurrence of an afterimage caused by the hysteresis in the voltage-current characteristics of the drive element.

Furthermore, the time up to when the source electrode of the drive element and the first electrode of the luminescence element reset can be adjusted using the timing for supplying the predetermined reset voltage to the second electrode of the capacitor within the period for supplying the reference voltage to the first electrode of the capacitor. As such, it is possible to shorten the time up to when the potential of the source electrode of the drive element stabilizes to a constant potential. Stated differently, it is possible to shorten the time up to when the gate-source voltage of the drive element becomes a constant voltage. In other words, the gate-source voltage of the drive element can be held longer to a constant voltage by as much as the amount of time eliminated in such shortening. Therefore, the voltage-current characteristics of the drive element can be set to substantially the initial state, without lengthening the non-luminescence-producing period. Therefore, it is possible to secure the desired display luminance, and prevent the occurrence of an afterimage due to the transient state in which the voltage-current characteristics of the drive element transiently changes.

FURTHER INFORMATION ABOUT TECHNICAL BACKGROUND TO THIS APPLICATION

The disclosure of PCT application No. PCT/JP2009/006717 filed on Dec. 9, 2009, including specification, drawings and claims is incorporated herein by reference in its entirety.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENTS (Underlying Knowledge Forming Basis of the Present Disclosure)

With regard to the voltage-current characteristics of the drive element, it is not necessarily the case that the same characteristics are always exhibited when the same voltage value is held in the capacitor. Stated differently, even when the same voltage value is held in the capacitor, there are cases where a current of a different current value flows. For example, (i) the current value corresponding to a voltage value when the held voltage value becomes 6 V as a result of 0 V being supplied to the electrode in the standard voltage-side of the capacitor and voltage supplied to the electrode of the capacitor which is connected to the gate of the drive element falling from −3 V to −6 V is different from (ii) the current value corresponding to the voltage value when the held voltage value becomes 6 V as a result of the voltage supplied to the electrode of the capacitor which is connected to the gate of the drive element rises from −9 V to −6V. This is caused by the voltage-current characteristics of the drive element being hysteretic characteristics.

Figure 12:
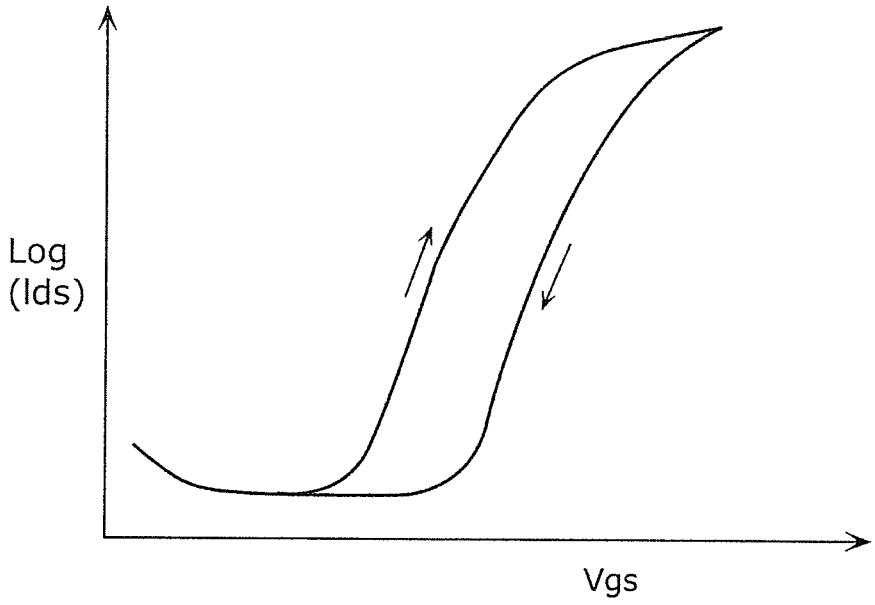
FIG. 12 is a graph showing an example of voltage-current characteristics of a drive element.

FIG. 12 is a graph showing an example of the voltage-current characteristics of the drive element.

As shown in the figure, since the voltage-current characteristics of the drive element includes hysteretic characteristics, a current that is larger or a current that is smaller than a desired current value flows even when the gate-source voltage of the drive element is the same.

An afterimage occurs when a current that is different from the desired current value flows due to such hysteretic characteristics.

In order to solve such afterimage problem, there is proposed a method of applying, as a gate voltage of a drive element, a reference voltage by which the drive element is turned OFF, after the luminescence production of the organic EL element (for example, Patent Reference 1: Japanese Unexamined Patent Application Publication No. 2008-3542).

Figure 13:
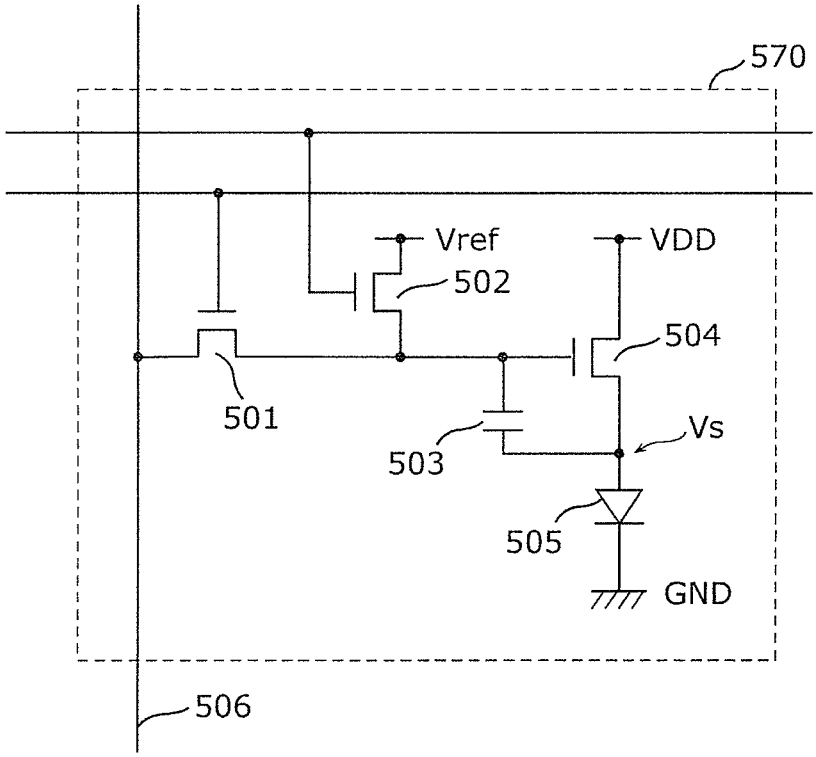
FIG. 13 is a circuit diagram showing the configuration of a pixel unit in a conventional display device using an organic EL element, disclosed in Patent Reference 1.

FIG. 13 is a circuit diagram showing the configuration of a pixel unit in a conventional display device using an organic EL element, disclosed in Patent Reference 1. A pixel unit 570 in the figure is configured of simple circuit elements such as: an organic EL element 505 having a cathode connected to a negative power source line (voltage value is 0 V); a drive thin film transistor (drive TFT) 504 having a drain connected to a positive power source line (voltage value is VDD) and a source connected to the anode of the organic EL element 505; a capacitor element 503 connected between the gate and source of the drive TFT 504 and which holds the gate voltage of the drive TFT 504; a first switching element 501 which selectively applies a data voltage from a signal line 506 to the gate of the drive TFT 504, and a second switching element 502 which initializes the gate potential of the drive TFT 504 to a reference voltage Vref.

The operation for writing a data voltage to the pixel unit 570 shall be described below.

After the luminance production of the organic EL element 505, a reference voltage Vref by which the drive TFT 504 is turned OFF (Vgs−Vth<0 when the drive TFT 504 is of the n-type (where, Vgs is the gate-source voltage of the drive TFT 504, and Vth is threshold voltage of the drive TFT 504)) is applied to the gate of the drive TFT 504 to turn OFF the drive TFT 504 (time t=0). For example, the reference voltage Vref is 0 V.

Subsequently, in time t=t1, the data voltage corresponding to the signal voltage of the next frame period is applied to the gate electrode of the drive TFT 504.

With this, the gate-source voltage of the drive TFT 504 is applied in a direction that raises voltage, at all times during data voltage writing. Therefore, it is possible to prevent the occurrence of an afterimage due to the inclusion of hysteresis in the voltage-current characteristics of the drive TFT 504. Specifically, the display device disclosed in Patent Reference 1 overcomes the occurrence of an afterimage by resetting the capacitor by writing a signal voltage corresponding to black data into the capacitor, and writing, into the reset capacitor, a signal voltage corresponding to a data voltage that is in accordance with the luminescence production luminance of the organic EL element 505.

However, in the configuration disclosed in Patent Reference 1, sufficient time is needed until the gate-source voltage of the drive TFT stabilizes, and there is the problem that, when the data voltage for the next frame period is applied to the gate of the drive TFT before a sufficient time has lapsed, the state of the preceding frame is not reset and thus an afterimage occurs.

The cause of the occurrence of the afterimage shall be described in detail below.

Figure 14:
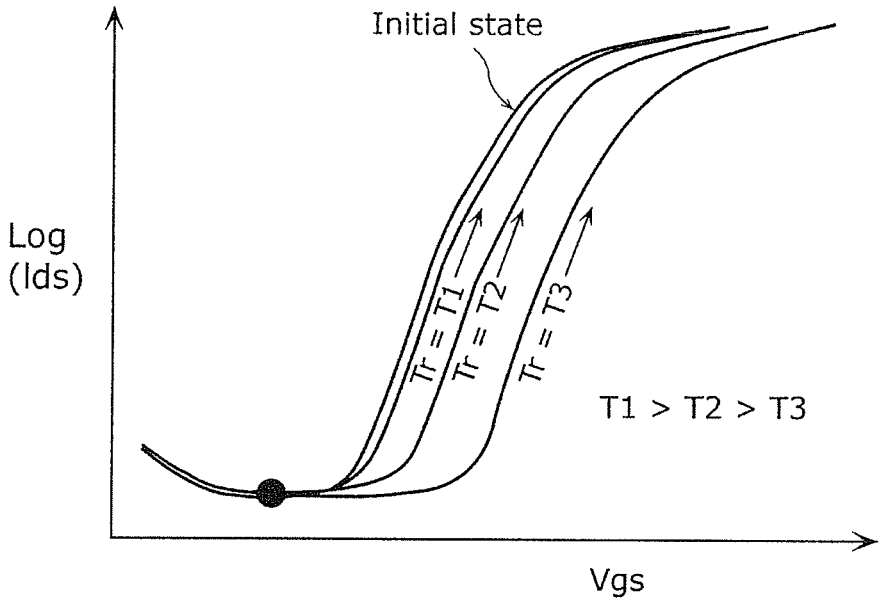
FIG. 14 is a graph showing an example of voltage-current characteristics of a TFT, according to a time from when the gate-source voltage falls to a predetermined voltage to when the gate-source voltage rises again.

FIG. 14 is a graph showing an example of voltage-current characteristics of a TFT, according to a time from when the gate-source voltage falls to a predetermined voltage to when the gate-source voltage rises again. The figure shows the voltage-current characteristics when the gate-source voltage rises from the low side to the high side, for each reset valid period Tr which is a time from when the gate-source voltage falls to a steady voltage to when the gate-source voltage rises again. Furthermore, T1>T2>T3.

As is clear from the figure, the longer the reset valid period of the TFT, the more the voltage-current characteristics approach the initial state. Stated differently, the voltage-current characteristics in the case where the time from when the TFT is turned OFF to when the TFT is turned ON is short and the voltage-current characteristics in the case where the time from when the TFT is turned OFF to when the TFT is turned ON is long, include different characteristics.

This is because, when the drive condition of the TFT changes from a certain condition to another certain condition, the voltage-current characteristics of the TFT changes with a certain time constant (ta). In other words, a voltage for achieving the desired steady state needs to be stably supplied between the gate and source of the TFT, from when the drive condition changes to when the voltage-current characteristics of the TFT reaches the initial state.

However, in the configuration in Patent Reference 1, the time from when the potential of the gate electrode of the drive TFT becomes a signal voltage corresponding to black data to when the potential of the source electrode of the TFT stabilizes is extremely long. Specifically, the potential of the source electrode of the drive TFT changes depending on a time constant that is predetermined according to luminance element characteristics. This time constant is determined by the capacitance component and the direct-current resistance component of the luminescence element, and, due to the direct-current resistance component of the luminescence element becoming larger as the luminescence element approaches the OFF state, the time constant of the luminescence element increases as the luminescence element approaches the OFF state. In other words, the potential of the source electrode does not readily stabilize.

Because a long time is needed until the potential of the source electrode of the drive TFT stabilizes, the amount of time for the voltage-current characteristics of the drive TFT to reach the initial state is difficult to secure in the non-luminescence-producing period, in which the luminescence element does not produce luminescence, in a 1-frame period. In other words, a sufficient reset valid time Tr cannot be secured. Therefore, even when the same data voltage is written into the pixel, a current that is larger or smaller than a desired current value flows to the luminescence element depending on the state of the pixel in the preceding frame. As a result, there is the problem that an afterimage occurs. Stated differently, there is the problem that an afterimage occurs due to the transient state of the voltage-current characteristics of the drive TFT.

On the other hand, when the non-luminescence-producing period is lengthened in order to secure the amount of time for the voltage-current characteristics of the drive TFT to reach the initial state, the luminescence producing period, in which the luminescence element produces luminescence, in the 1-frame period becomes short, and thus there is the problem that either the display luminance deteriorates or operating life is shortened due to increased operating load on the luminescence element in order to increase instantaneous luminescence production intensity to have the same degree of display luminance.

In view of the above-described problems, the display device according to an aspect of the present invention includes: a luminescence element including a first electrode and a second electrode; a capacitor which holds a voltage; a drive element which includes a gate electrode connected to a first electrode of the capacitor, and a source electrode connected to the first electrode of the luminescence element, and which supplies a drain current corresponding to the voltage held in the capacitor to the luminescence element so that the luminescence element produces luminescence; a power source line for supplying a reference voltage which defines a voltage value of the gate electrode of the drive element for placing the luminescence element in an OFF state; a first switching element which supplies the reference voltage to the gate electrode of the drive element; a data line for supplying a signal voltage and a predetermined reset voltage; a second switching element which includes one of terminals connected to the data line, and an other of the terminals connected to a second electrode of the capacitor, and which switches between conduction and non-conduction between the data line and the second electrode of the capacitor; and a drive circuit which controls the first switching element and the second switching element, wherein the drive circuit: turns ON the first switching element so that the reference voltage is supplied to the gate electrode of the drive element and the luminescence element is placed in the OFF state, and turns ON the second switching element in a period in which the first switching element is ON so that the predetermined reset voltage is applied from the data line to a connection point between the first electrode of the luminescence element and the source electrode of the drive element.

According to this aspect, the first electrode of the capacitor is connected to the gate electrode of the drive element, and the second electrode of the capacitor is connected to the data line via the second switching element. Furthermore, there is provided a first switching element for supplying, to the gate electrode of the drive element, the reference voltage which defines the voltage value of the gate electrode for stopping the drain current of the drive element. Then, by turning ON the first switching element, the reference voltage is supplied by the drive capacitor to the first electrode of the capacitor. With this, the drain current of the drive element is stopped, and thus there is a non-connected state between the source and drain of the drive element. In the period in which there is no connection between the source and drain of the drive element, the drive circuit turns ON the second switching element such that the predetermined reset voltage is applied to the connection point between the first electrode of the luminescence element and the source electrode of the drive element.

With this, the potential of the source electrode of the drive element and the first electrode of the luminescence element are instantaneously reset to the predetermined reset voltage. Specifically, in the period in which there is no connection between the source and drain of the drive element, the predetermined reset voltage is applied to the connection point between the first electrode of the luminescence element and the source electrode of the drive element, thereby forcibly resetting the potentials of the source electrode of the drive element and the first electrode of the luminescence element. Therefore, since the gate-source voltage of the drive element can be reset to the difference voltage between the reference voltage and the predetermined reset voltage, it is possible to prevent the occurrence of an afterimage caused by the hysteresis in the voltage-current characteristics of the drive element.

Furthermore, the time up to when the source electrode of the drive element and the first electrode of the luminescence element reset can be adjusted using the timing for supplying the predetermined reset voltage to the second electrode of the capacitor within the period for supplying the reference voltage to the first electrode of the capacitor. As such, it is possible to shorten the time up to when the potential of the source electrode of the drive element stabilizes to a constant potential. Stated differently, it is possible to shorten the time up to when the gate-source voltage of the drive element becomes a constant voltage. In other words, the gate-source voltage of the drive element can be held longer to a constant voltage by as much as the amount of time eliminated in such shortening. Therefore, the voltage-current characteristics of the drive element can be set to substantially the initial state, without lengthening the non-luminescence-producing period. Therefore, it is possible to maintain display luminance, and prevent the occurrence of an afterimage due to the transient state in which the voltage-current characteristics of the drive element transiently changes.

Furthermore, as described above, by being able to place the voltage-current characteristics of the drive element to substantially the initial state in a short time, the occurrence of an afterimage due to the voltage-current characteristics of the drive element can be prevented even when the non-luminescence-producing period, which is the time from when the drain current of the drive element is stopped to when the drain current is supplied again, is set to be a shorter time than conventional. Therefore, the luminescence producing period can be secured for a longer time.

Furthermore, according to the display device in an aspect of the present invention, a timing for turning ON the first switching element and a timing for turning ON the second switching element are simultaneous.

According to this aspect, the timing at which the first switching element is turned ON and the timing at which the second switching element is turned ON are made simultaneous. In this case, assuming that the on-resistance of the second switching element is 100 kΩ and the total capacitance of the luminescence element and the capacitor is 3 pF for example, the time constant of the charge-discharge of the total capacitance becomes 0.3 μseconds, and the time up to when the source electrode of the drive element transitions to a steady potential can be shortened to substantially 10 μseconds or less, and thus it is possible to shorten the time from when the reference voltage is applied to the gate electrode of the drive element to when the voltage-current characteristics of the drive element reaches the initial state. Therefore, the luminescence producing period of the luminescence element can be secured to a maximum extent.

Furthermore, according to the display device in an aspect of the present invention, the drive circuit: turns ON the first switching element after turning OFF the first switching element and the second switching element so that the reference voltage is supplied to the gate electrode of the drive element and the luminescence element is placed in the OFF state, and turns ON the second switching element in the period in which the first switching element is ON, so as to apply the signal voltage to the second electrode of the capacitor so that a desired voltage is held in the capacitor.

According to this aspect, there is provided a first switching element which sets, to the gate electrode of the drive element, the reference voltage which defines the voltage value of the gate electrode for stopping the drain current of the drive element. Then, by turning ON the first switching element, the reference voltage which defines the voltage value of the gate electrode for stopping the drain current of the drive element is supplied to the gate electrode of the capacitor. With this, the drain current of the drive element is stopped, and thus there is a non-connected state between the source and drain of the drive element. In this state, the second switching element is turned ON such that the desired voltage is held in the capacitor.

With this, the potential difference between the gate electrode and the source electrode of the drive element is set to the desired voltage after being set to the difference voltage between the reference voltage and the reset voltage. Specifically, since the desired voltage is held in the capacitor in the state in which the potential difference between the gate electrode and the source electrode of the drive element is reset, it is possible to stabilize the luminescence production amount of the luminescence element, which corresponds to the signal voltage Vdata, without being affected by the hysteresis of the voltage-current characteristics of the drive element.

Furthermore, according to the display device in an aspect of the present invention, after turning ON the second switching element so that the desired voltage is held in the capacitor, the drive circuit turns OFF the first switching element and the second switching element.

According to this aspect, after turning ON the second switching element so that the desired voltage is held in the capacitor, the first switching element and the switching element are turned OFF. With this, according to the drive element, a current corresponding to the desired voltage held in the capacitor flows to the luminescence element and thus it is possible to cause the luminescence element to produce luminescence.

Furthermore, the display device in an aspect of the present invention further includes a third switching element provided in series between the first electrode of the luminescence element and the second electrode of the capacitor, wherein the drive circuit: turns ON the second switching element in a period in which the third switching element is OFF, so as to apply the signal voltage to the second electrode of the capacitor so that a desired voltage is held in the capacitor; turns OFF the first switching element and the second switching element after the desired voltage is held in the capacitor; and turns ON the third switching element.

According to this aspect, there is provided a third switching element which, by being inserted between the first electrode of the luminescence element and the second electrode of the capacitor, controls the connection between the first electrode of the luminescence element and the second electrode of the capacitor. In addition, the desired voltage corresponding to the signal voltage is stored in the capacitor while the third switching transistor is turned OFF, and the third switching transistor is turned ON after the desired voltage is held in the capacitor. With this, it is possible to set a voltage corresponding to the signal voltage in a state in which current does not flow between the source electrode of the drive element and the second electrode of the capacitor. Specifically, it is possible to prevent the fluctuation of the potential of the second electrode of the capacitor caused by current flowing into the second electrode of the capacitor via the drive element before the desired voltage is held in the capacitor. As such, since the desired voltage can be precisely held in the capacitor, it is possible to prevent the voltage intended to be held in the capacitor from fluctuating such that the luminescence element does not produce luminescence precisely at the luminescence production amount reflecting the image signal. As a result, it is possible to cause the luminescence element to produce luminescence precisely at the luminescence production amount corresponding to the signal voltage, and realize high-precision image display.

With the above, it is possible to achieve the function (pixel stopping function) for stopping the drain current of the drive element by using the first switching element which supplies the gate electrode of the drive element with the reference voltage which defines the voltage value of the gate electrode for stopping the drain current of the drive element, and thus solve the problem of hysteresis in the voltage-current characteristics of the drive element using a simple configuration, and it is possible to cause the desired voltage to be precisely held in the capacitor by using the third switching transistor which controls the connection between the source electrode of the drive element and the second electrode of the capacitor.

Furthermore, according to the display device in an aspect of the present invention, the luminescence element, the capacitor, the drive element, the first switching element, and the second switching element are included in a pixel circuit of a unit pixel, and the drive circuit sets, in common for predetermined pixels, a period in which the second switching element is ON and a period in which the second switching element is OFF.

According to this aspect, the period (reset period) in which the reference voltage is supplied to the gate electrode of the drive element by turning ON the first switching element and the period (data writing period) in which a voltage corresponding to the signal voltage is caused to be held in the capacitor by turning ON the second switching element are made to overlap. With this, the reset period and the data writing period can be shared among predetermined pixels. As such, it is possible to share a scanning line for controlling the first switching element by predetermined pixels, and thus reduce the number of scanning lines as a whole.

Furthermore, according to the display device in an aspect of the present invention, the luminescence element, the capacitor, the drive element, the first switching element, the second switching element, and the third switching element are included in a pixel circuit of a unit pixel, and the drive circuit: sets, in common for predetermined pixels, a period in which the second switching element is ON and a period in which the second switching element is OFF, and sets, in common for the predetermined pixels, a period in which the third switching element is ON and the period in which the third switching element is OFF.

According to this aspect, the period (reset period) in which the reference voltage is supplied to the gate electrode of the drive element by turning ON the first switching element and the period (data writing period) in which a voltage corresponding to the signal voltage is caused to be held in the capacitor by turning ON the second switching element are made to overlap. With this, the reset period and the data writing period can be shared among predetermined pixels. As such, a scanning line for controlling the first switching element can be shared by predetermined pixels, and thus it is possible to reduce the number of scanning lines as a whole.

Furthermore, by sharing, among the predetermined pixels, the period (luminescence producing period) in which the first electrode of the luminescence element and the second electrode of the capacitor are connected by turning ON the third switching element, a scanning line for controlling the third switching element can be shared by predetermined pixels, and thus it is possible to reduce the number of scanning lines as a whole.

Furthermore, according to the display device in an aspect of the present invention, the first electrode of the luminescence element is an anode electrode, and the second electrode of the luminescence element is a cathode electrode.

According to the present aspect, the drive element is configured of an n-type transistor.

Furthermore, the display device in an aspect of the present invention further includes: a first scanning line for supplying a signal for controlling conduction and non-conduction of the first switching element; and a second scanning line for supplying a signal for controlling conduction and non-conduction of the second switching element, wherein the first scanning line and the second scanning line are a common scanning line.

According to this aspect, the first scanning line and the second scanning line can be a common scanning line. In this case, the number of scanning lines for controlling the switching element can be reduced, and thus the circuit configuration can be simplified.

Furthermore, according to the display device in an aspect of the present invention, a voltage value of the predetermined reset voltage is set such that, when the predetermined reset voltage is applied from the data line to the connection point between the first electrode of the luminescence element and the source electrode of the drive element, a potential difference between the gate electrode of the drive element and the source electrode of the drive element is a voltage that is lower than a threshold voltage with which the drive element turns ON.

According to this aspect, when the predetermined reset voltage is applied to the connection point between the first electrode of the luminescence element and the source electrode of the drive element, the voltage value of the predetermined reset voltage is set such that the drive element is not turned ON. Accordingly, since the drive element is not turned ON during the reset period, it is possible to prevent the luminescence element from producing luminescence. In addition, since the luminescence element does not produce luminescence even when a long reset period is provided, it is possible to keep the drive element in the reset state while preventing contrast deterioration.

As such, it is possible to cause a current corresponding to the desired potential difference to flow to the luminescence element, in the luminescence producing period, and thus the luminescence production amount of the luminescence element can be precisely controlled.

Furthermore, according to the display device in an aspect of the present invention, the voltage value of the predetermined reset voltage is further set such that, when the predetermined reset voltage is applied from the data line to the connection point between the first electrode of the luminescence element and the source electrode of the drive element, the potential difference between the first electrode of the luminescence element and the second electrode of the luminescence element is a voltage that is lower than a threshold voltage of the luminescence element with which the luminescence element starts to produce the luminescence.

According to this aspect, when the predetermined reset voltage is applied to the connection point between the first electrode of the luminescence element and the source electrode of the drive element, the voltage value of the predetermined reset voltage is set such that the drive element is not turned ON. Accordingly, it is possible to prevent the luminescence element from producing luminescence even in the reset period and at the time of reset voltage application, and thus it is possible to more effectively keep the drive element in the reset state while preventing contrast deterioration.

Furthermore, according to the display device in an aspect of the present invention, the luminescence element includes plural luminescence elements arranged in a matrix.

Furthermore, according to the display device in an aspect of the present invention, the luminescence element and the third switching element are included in a pixel circuit of a unit pixel, and the pixel circuit includes plural pixel circuits arranged in a matrix.

Furthermore, according to the display device in an aspect of the present invention, the luminescence element, the capacitor, the drive element, the first switching element, the second switching element, and the third switching element are included in a pixel circuit of a unit pixel, and the pixel circuit includes plural pixel circuits arranged in a matrix.

Furthermore, according to the display device in an aspect of the present invention, the luminescence pixel is an organic electroluminescence (EL) luminescence element.

Furthermore, the method of controlling a display device, according to an aspect of the present invention, the display device including: a luminescence element including a first electrode and a second electrode; a capacitor which holds a voltage a drive element which includes a gate electrode connected to a first electrode of the capacitor, and a source electrode connected to the first electrode of the luminescence element, and which supplies a drain current corresponding to the voltage held in the capacitor to the luminescence element so that the luminescence element produces luminescence; a power source line for supplying a reference voltage which defines a voltage value of the gate electrode of the drive element for placing the luminescence element in the OFF state; a first switching element which supplies the reference voltage to the gate electrode of the drive element; a data line for supplying a signal voltage and a predetermined reset voltage; a second switching element which includes one of terminals electrically connected to the data line, and an other of the terminals electrically connected to a second electrode of the capacitor, and which switches between conduction and non-conduction between the data line and the second electrode of the capacitor; and a drive circuit which controls the first switching element and the second switching element, the method including the following performed by the drive circuit: turning ON the first switching element so that the reference voltage is supplied to the gate electrode of the drive element and the luminescence element is placed in the OFF state, and turning ON the second switching element in a period in which the first switching element is ON so that the predetermined reset voltage is applied from the data line to a connection point between the first electrode of the luminescence element and the source electrode of the drive element.

Hereinafter, the preferred embodiments of the present invention shall be described based on the Drawings. It is to be noted that, in all the figures, the same reference numerals are given to the same or corresponding elements and redundant description thereof shall be omitted.

Embodiment 1

Hereinafter, Embodiment 1 of the present invention shall be specifically described with reference to the Drawings.

Figure 1:
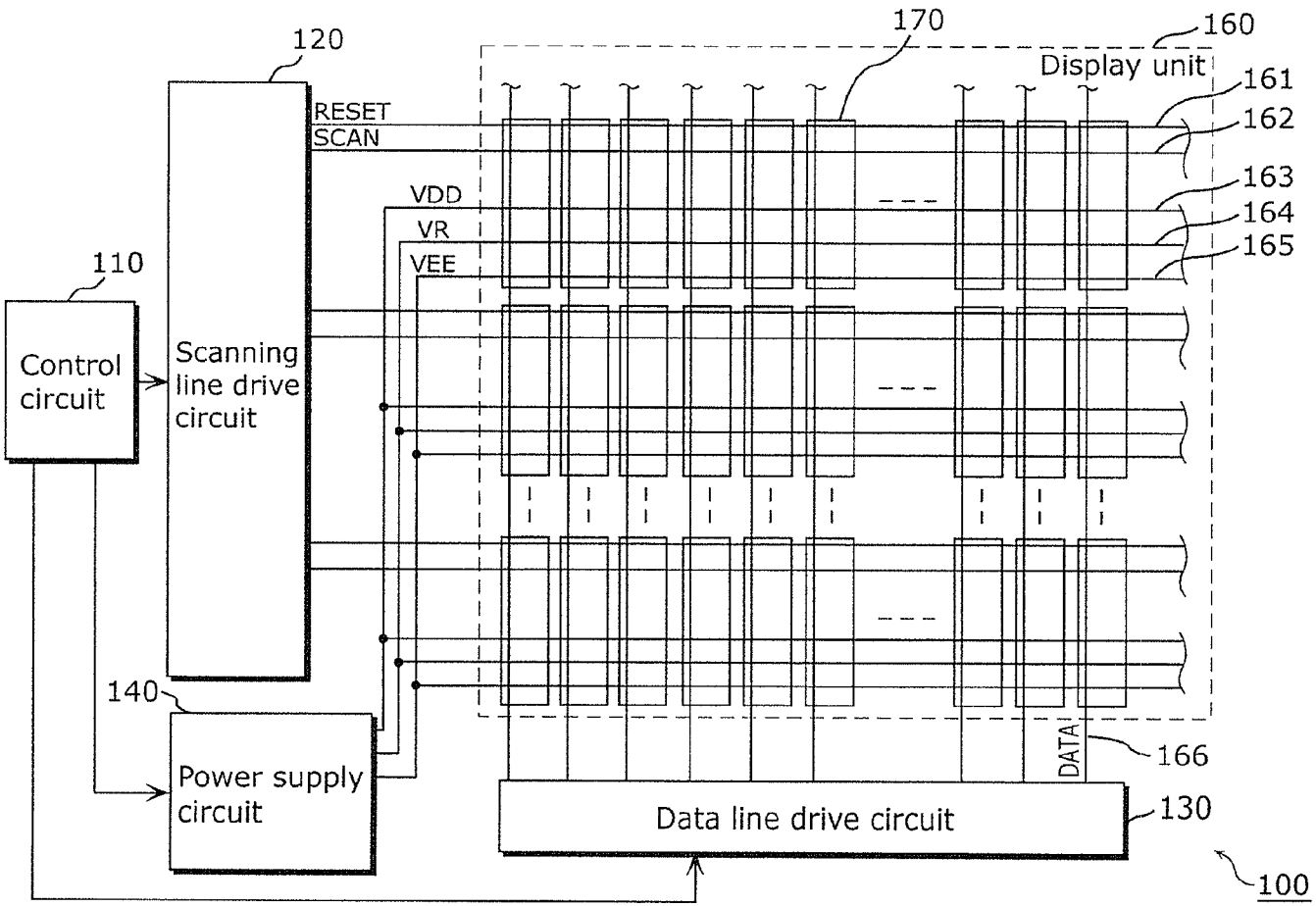
FIG. 1 is a block diagram showing a configuration of a display device according to Embodiment 1.

FIG. 1 is a block diagram showing an electrical configuration of a display device according to the present embodiment.

A display device 100 shown in the figure includes a control circuit 110, a scanning line drive circuit 120, a data line drive circuit 130, a power supply circuit 140, a display unit 160, reset lines 161, scanning lines 162, first power source lines 163, reference power source lines 164, second power source lines 165, and data lines 166.

The display unit 160 includes luminescence pixels 170 which are arranged in a matrix. It should be noted that each of the reset lines 160 is the first scanning line in the present invention, and each of the scanning lines 162 is the second scanning line in the present invention.

Figure 2:
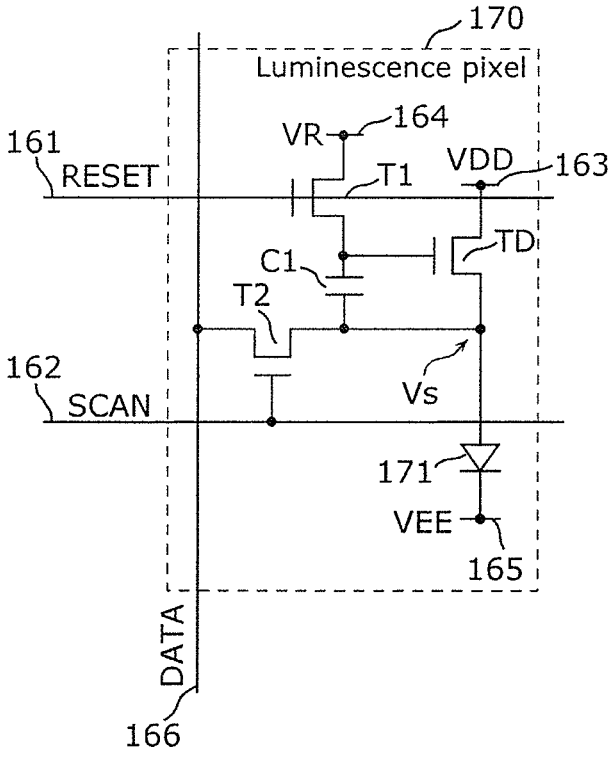
FIG. 2 is a circuit diagram showing a detailed circuit configuration of a luminescence pixel.

FIG. 2 is a circuit diagram showing a detailed circuit configuration of a luminescence pixel.

The luminescence pixel 170 shown in the figure includes a first switching transistor T1, a second switching transistor T2, a drive transistor TD, a capacitor C1, and a luminescence element 171. Furthermore, a reset line 161, a scanning line 162, a first power source line 163, a second power source line 165, and a reference power source line 164 are provided to the luminescence pixel 170 on a row basis.

The connection relationships and functions of each constituent element shown in FIG. 1 and FIG. 2 is described below.

The control circuit 110 controls the scanning line drive circuit 120, the data line drive circuit 130, and the power supply circuit 140.

Furthermore, the control circuit 110 controls the first switching transistor T1 and the second switching transistor T2 via the scanning line drive circuit 120.

The scanning line drive circuit 120, which is the drive circuit in the present invention, controls the first switching transistor T1 and the second switching transistor T2. Specifically, the scanning line drive circuit 120 is connected to the reset lines 161 and the scanning lines 162, one each of which is provided corresponding to one of the rows of the luminescence pixels 170. The scanning line drive circuit 120 sequentially scans the luminescence pixels 170 on a row basis by outputting a scanning signal to the respective reset lines 161 and the respective scanning lines 162 according to a timing instructed from the control circuit 110. More specifically, the scanning line drive circuit 120 controls the first switching transistors T1 on a row basis by supplying, to the respective reset lines 161, a reset pulse RESET which is a signal for controlling the turning ON and OFF of the first switching transistor T1. Furthermore, the scanning line drive circuit 120 controls the second switching transistors T2 on a row basis by supplying, to the respective scanning lines 162, a scanning pulse SCAN which is a signal for controlling the turning ON and OFF of the second switching transistor T2.

The data line drive circuit 130 is connected to data lines 166 each of which is provided corresponding to one of the columns of the luminescence pixels. The data line drive circuit 130 supplies, to the respective data lines 166, a data line voltage DATA which has a signal voltage Vdata and a predetermined reset voltage Vreset, according to a timing instructed from the control circuit 110. Stated differently, the data line drive circuit 130 selectively supplies the signal voltage Vdata and the reset voltage Vreset to the data line 166. Here, the signal voltage Vdata is a voltage that corresponds to the luminescence production luminance of a luminescence pixel 170, and is −5 V to 0 V assuming that the threshold voltage of the drive transistor is 1 V. The reset voltage Vreset is a voltage that defines the source voltage of the drive transistor TD in a non-luminescence-producing period of the luminescence pixel 170, and is for example 0 V.

The power supply circuit 140 is connected to the first power source lines 163, the reference power source lines 164, and the second power source lines 165, which are provided for all the luminescence pixels 170. The power supply circuit 140 sets and supplies, according to an instruction from the control circuit 110, a first power source voltage VDD of the first power source lines 163, a reference voltage VR of the reference power lines 164, and a second power source voltage VEE of the second power source lines 165. Here, for example, the first power source voltage VDD is 15 V, the second power source voltage VEE is 0 V, and the reference voltage VR is 0 V. It should be noted that the reference power line 164, which is the power source line in the present invention, supplies the reference voltage VR which defines the voltage value of the gate electrode of the drive transistor TD for stopping the drain current of the drive transistor TD.

The display unit 160 displays an image based on an image signal inputted to the display device 100 from an external source. The display unit 160 includes luminescence pixels 170 which are arranged in a matrix. Specifically, the display unit 160 includes luminescence elements 171 which are arranged in a matrix.

The first switching transistor T1, which is the first switching element in the present invention, selectively supplies the reference voltage VR to the gate electrode of the drive transistor TD. Specifically, the first switching transistor T1 has a gate electrode connected to the reset line 161, one of a source electrode and a drain electrode connected to the reference power line 164, the other of the source electrode and the drain electrode connected to the gate electrode of the drive transistor TD and the first electrode of the capacitor C1. The first switching transistor T1 turns ON and OFF according to the reset pulse RESET. For example, the first switching transistor T1 is an n-type thin film transistor (TFT), and supplies the reference voltage VR to the gate electrode of the drive transistor TD and the first electrode of the capacitor C1 by being turned ON in the period in which the reset pulse RESET is at the high level.

The second switching transistor T2, which is the second switching element in the present invention, selectively supplies the reset voltage Vreset and the signal voltage Vdata to the source electrode of the drive transistor TD and the second electrode of the capacitor C1. Specifically, the second switching transistor T2 is connected between the second electrode of the capacitor C1 and the scanning line 162, and turns ON and OFF according to a scanning pulse SCAN. For example, the second switching transistor T2 is an n-type thin film transistor (TFT), and sets the data line voltage DATA to the source electrode of the drive transistor TD and the second electrode of the capacitor C1 by being turned ON in the period in which the scanning pulse SCAN is at the high level. Specifically, the second switching transistor T2 has a gate electrode, a source electrode, and a drain electrode. The gate electrode is connected to the scanning line 162, one of the source electrode and the drain electrode connected to the reference power line 164, the other of the source electrode and the drain electrode is connected to the data line 166, and the other of the source electrode and the drain electrode is connected to the source electrode of the drive transistor TD and the second electrode of the capacitor C1.

The drive transistor TD, which is the drive element in the present invention, causes the luminescence element 171 to produce luminescence by supplying current to the luminescence element 171. Specifically, the drive transistor TD has: a gate electrode connected to the other of the source electrode and the drain electrode of the first switching transistor T1 and to the first electrode of the capacitor C1; a source electrode connected to the first electrode of the luminescence element 171 and to the second electrode of the capacitor C1; and a drain connected to the first power source line 163. The drive transistor TD effects a flow of drain current corresponding to the potential difference between the potential of the gate electrode and the potential of the source electrode thereof. In other words, the drive transistor TD supplies the luminescence pixel 171 with a drain current corresponding to the voltage held in the capacitor C1. For example, the drive transistor TD is an n-type thin film transistor (TFT).

The luminescence element 171 is an element which has the first electrode and the second electrode and produces luminescence according to the flow of current, and is, for example, an organic EL luminescence element. Specifically, the luminescence element 171 has the first electrode connected to the source electrode of the drive transistor TD, and the second electrode connected to the second power source line 165. As shown in FIG. 2, for example, the first electrode is an anode electrode and the second electrode is a cathode electrode. The luminescence element 171 produces luminescence according to the drain current of the drive transistor TD which corresponds to a voltage VR−Vdata+δV which is the potential difference between (i) the reference voltage VR applied to the gate electrode of the drive transistor TD via the reference power source line 164 and the first switching transistor T1, and (ii) the signal voltage Vdata−δV applied to the source electrode of the drive transistor TD via the data line 166 and the second switching transistor T2. Here, δV is the voltage difference arising from the flow of the drain current of the drive transistor TD to the second switching transistor T2 when the second switching transistor T2 is turned ON such that the signal voltage Vdata is applied to the source electrode of the drive transistor TD. In other words, the luminance of the luminescence pixel 171 corresponds to the signal voltage Vdata applied to the signal line 166.

The capacitor C1 has a first electrode and a second electrode. The first electrode is connected to the other of the source electrode and the drain electrode of the first switching transistor T1 and to the gate electrode of the drive transistor TD, and the second electrode is connected to the other of the source electrode and the drain electrode of the second switching transistor T2, the source electrode of the drive transistor TD, and the anode electrode of the luminescence element 171. In other words, the capacitor C1 is capable of holding the gate-source voltage of the drive transistor TD.

Next, a method of driving the above-described display device 100 shall be described using FIG. 3 to FIG. 5D.

Figure 3:
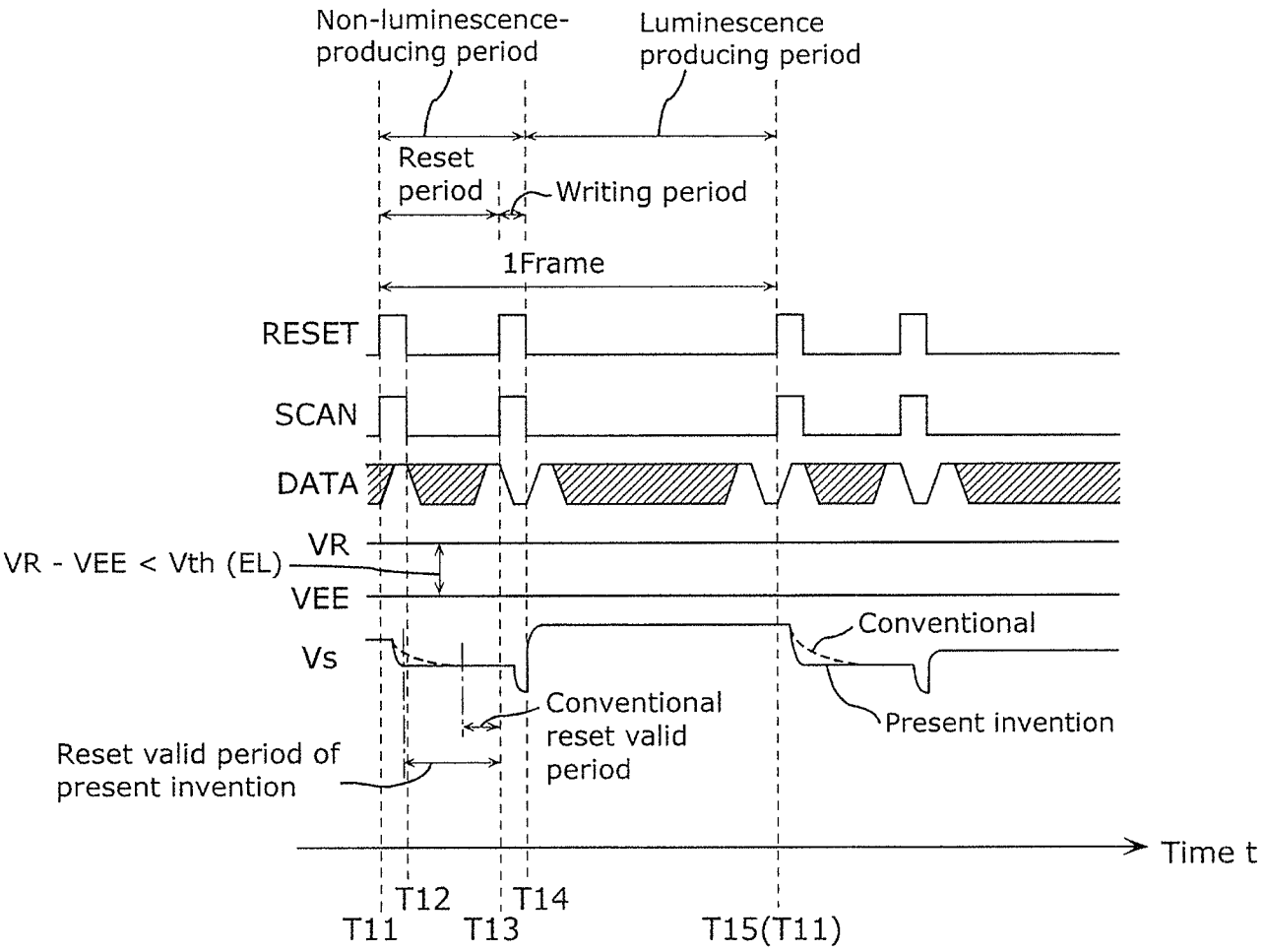
FIG. 3 is an operation timing chart for describing a method of controlling the display device.

FIG. 3 is an operation timing chart for describing a method of controlling the display device 100 according to the present embodiment. In the figure, the horizontal axis denotes time. Furthermore, the waveform charts of the reset pulse RESET, the scanning pulse SCAN, the data line voltage DATA, the reference voltage VR, the second power source voltage VEE, and the voltage Vs of the source electrode of the drive transistor TD are shown sequentially from the top in the vertical direction.

It should be noted that the voltage of the source electrode of the drive TFT 504 in the conventional display device is also shown in the figure for comparison. Furthermore, in the figure, the data line voltage DATA is illustrated focusing on the signal voltage Vdata and the reset voltage Vreset supplied to one luminescence pixel 170, among the signal voltage Vdata and the reset voltage Vreset supplied to the luminescence pixels 170 corresponding to the data line 166. In the period in which the data line voltage DATA is shown as a hatched line, the signal voltage Vdata and the reset voltage Vreset are supplied to any one of the luminescence pixels 170 other than the one luminescence pixel 170.

Figure 4:
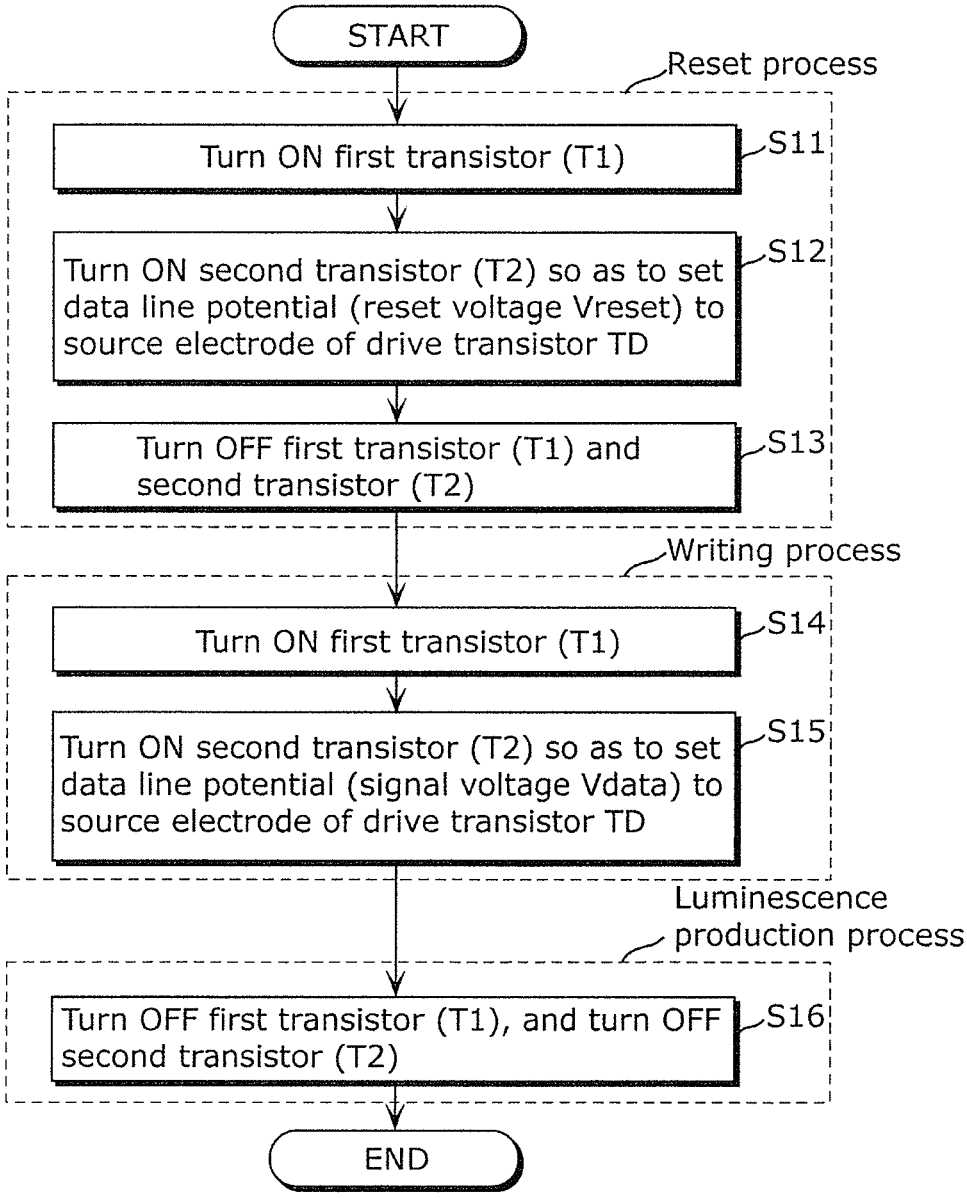
FIG. 4 is an operation flowchart for describing the method of controlling the display device.

Furthermore, FIG. 4 is an operation flowchart for describing the method of controlling the display device 100 according to the present embodiment.

First, at a time t=T11, the scanning line drive circuit 120 causes the first switching transistor T1 to turn ON by switching the reset pulse RESET from the low level to the high level (step S11 in FIG. 4). With this, there is conduction between (i)

the reference power source line 164 and (ii) the first electrode of the capacitor C1 and the gate electrode of the drive transistor TD, and thus the voltage of the first electrode of the capacitor C1 and the gate electrode of the drive transistor TD becomes the reference voltage VR.

Simultaneously, at the time t=T11, the scanning line drive circuit 120 causes the second switching transistor T2 to turn ON by switching the scanning pulse SCAN from the low level to the high level. With this there is conduction between the source electrode of the drive transistor TD and the data line 166, and thus the reset voltage Vreset is set to the source electrode of the drive transistor TD (step S12 in FIG. 4). Furthermore, by turning ON the second switching transistor T2, there is also conduction between the second electrode of the capacitor C1 and the data line 166 such that the reset voltage Vreset is set to the capacitor C1. At this point, in order that the drive transistor TD and the luminescence element 171 are not placed in the ON state, Vreset is precisely applied to the source electrode of the drive transistor TD and the second electrode of the capacitor C1, without current flowing to the second switching transistor T2.

In the period t=T11 to T12, the reset pulse RESET is at the high level, and thus the reference voltage VR is continuously applied to the first electrode of the capacitor C1 and the gate electrode of the drive transistor TD. Furthermore, since the scanning pulse SCAN is at the high level, the reset voltage Vreset is continuously applied to the second electrode of the capacitor C1 and the source electrode of the drive transistor TD.

Figure 5A:
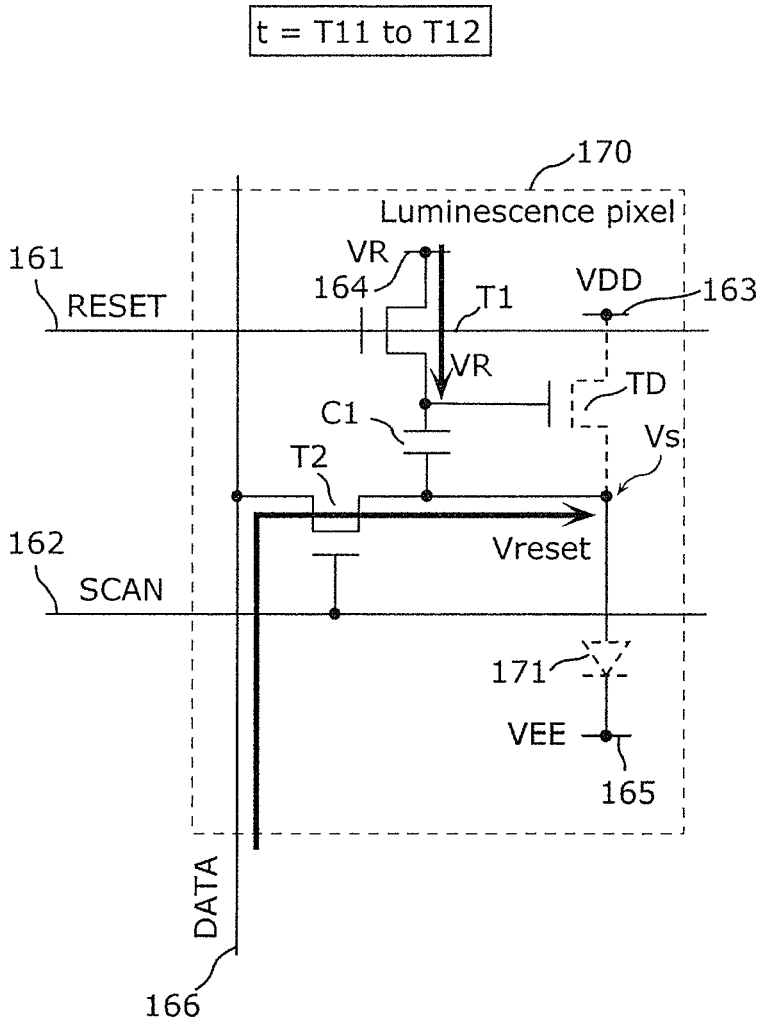
FIG. 5A is a circuit diagram schematically showing the state of a luminescence pixel in t=T11 to T12.

FIG. 5A is a circuit diagram schematically showing the state of a luminescence pixel in the period t=T11 to T12.

As shown in the figure, the reference voltage VR of the reference power source line 164 is applied to the gate electrode of the drive transistor TD, and the reset voltage Vreset of the data line 166 is applied to the source electrode of the drive transistor TD. Specifically, in the period t=T11 to T12, the drain current of the drive transistor TD is caused to stop by turning ON the first switching transistor T1 so that the reference voltage VR is supplied to the gate electrode of the drive transistor TD. Furthermore, by turning ON the second switching transistor T2, the predetermined reset voltage Vreset from the data line 166 is applied to the connection point between the anode electrode of the luminescence element 171 and the source electrode of the drive transistor TD.

With this, the potential Vs of the source electrode of the drive transistor TD immediately transitions from the signal voltage Vdata of the immediately preceding frame to the reset voltage Vreset. The time needed for this transition of the potential is extremely short compared to the time need from when the drive TFT 504 of the conventional display device is turned OFF to when the potential of the source electrode of the drive TFT transitions to a steady value. This is because the potential of the source electrode of the drive transistor TD of the display device 100 according to the present embodiment is defined by the charge time constant determined by the on-resistance of the second switching transistor T2 and the capacitance component of the luminescence element 171, without being affected by the self-discharge time constant determined by the capacitance component of the luminescence element 171 and the direct-current resistance component of the luminescence element 171. Since the direct-current resistance of the luminescence element 171 is several MΩ in the ON state and several hundred MΩ in the OFF state, and the on-resistance of a switching transistor is several hundred kΩ, transition at a speed that is approximately 10 to 1000 times faster becomes possible. This can be considered as being substantially zero because, when the capacitance of the luminescence element 171 is 1 pF, conventionally several milliseconds are needed for the transition time to the above-described reset potential whereas in the present embodiment, such transition time becomes several μ seconds and the length of the luminescence producing period is 16 milliseconds.

Therefore, compared to the conventional display device, the reset valid period can be lengthened in the display device 100 according to the present embodiment. Therefore, occurrence of an afterimage due to the transient state of the voltage-current characteristics of the drive transistor TD can be prevented. In addition, since there is no need to take a long non-luminescence-producing period in a 1-frame period, the display luminance can be maintained.

Furthermore, as described above, by making the timing for turning ON the first switching transistor T1 and the timing for turning ON the switching transistor T2 simultaneous, it is possible to shorten, to substantially zero, the time from when the potential of the gate electrode of the drive transistor TD becomes the reference voltage VR to when the potential of the source electrode of the drive transistor TD transitions to a steady potential. Therefore, it is possible to minimize the time from when the reference voltage VR is applied to the gate electrode of the drive transistor TD to when the voltage-current characteristics of the drive transistor TD reaches the initial state. Therefore, the luminescence producing period of the luminescence element 171 can be secured to a maximum extent.

Meanwhile, the potential relationship among the reference voltage VR, the second power source voltage VEE, and the reset voltage Vreset is VR−Vth (TD)≤Vreset≤Vdata (max) ≤VEE+Vth (EL). However, Vth (TD) is the threshold voltage of the drive transistor TD, Vth (EL) is the threshold voltage of the luminescence element 171, and Vdata (max) is the maximum value for the signal voltage Vdata. Therefore, since the driving transistor TD is not turned ON at the time of writing Vreset, and the luminescence element 171 does not produce luminescence, the reset state is achieved instantaneously. Furthermore, the luminescence element 171 also does not produce luminescence at the time of writing the signal voltage Vdata.

Stated differently, during the application of the reset voltage Vreset from the data line 166 to the connection point between the anode electrode of the luminescence element 171 and the source electrode of the drive transistor TD, the reset voltage Vreset is set by the control circuit 110 and the data line drive circuit 130 so that the potential difference between the gate electrode and source electrode of the drive transistor TD becomes a voltage that is lower than Vth (TD). With this, since the drive transistor TD is not turned ON during the reset period, it is possible to prevent the luminescence element 171 from producing luminescence, and the luminescence element 171 does not produce luminescence even when a long reset period is provided. Therefore, it is possible to keep the drive transistor TD in the reset state while preventing the deterioration of contrast.

In addition, during the application of the reset voltage Vreset from the data line 166 to the connection point between the anode electrode of the luminescence element 171 and the source electrode of the drive transistor TD, the reset voltage Vreset is set by the control circuit 110 and the data line drive circuit 130 so that the potential difference between the anode electrode and cathode electrode of the luminescence element 171 becomes a voltage that is lower than Vth (EL). With this, it is possible to prevent the luminescence element 171 from producing luminescence even at the time when reset voltage Vreset is applied, and, in addition, it is possible to keep the drive transistor TD in the reset state while effectively preventing the deterioration of contrast.

Next, at the time t=T12, the scanning line drive circuit 120 causes the first switching transistor T1 to turn OFF by switching the reset pulse RESET from the high level to the low level. Furthermore, the scanning line drive circuit 120 causes the second switching transistor T2 to turn OFF by switching the scanning pulse SCAN from the high level to the low level (step S13 in FIG. 4). With this, the capacitor C1 holds VR−Vreset which is the potential difference between (i) the reference voltage VR applied to the first electrode until just before and (ii) the reset voltage Vreset applied to the second electrode until just before the time t=T12. Since the voltages of both the first electrode and the second electrode of the capacitor C1 are set in this manner, it is possible to cause the holding of a precise potential difference in the capacitor C1. It should be noted that the steps S11 to S13 in FIG. 4 up to this point constitute a reset process of the luminescence pixel 170.

Since the reset pulse RESET and the scanning pulse SCAN are at the low level in a period t=T12 to T13, the capacitor C1 continues to hold the voltage VR−Vreset, and since the luminescence element 171 and the drive transistor TD are OFF, the source potential of the drive transistor TD continues to be Vreset. Therefore, the gate potential of the drive transistor TD also continues to be VR.

Figure 5B:
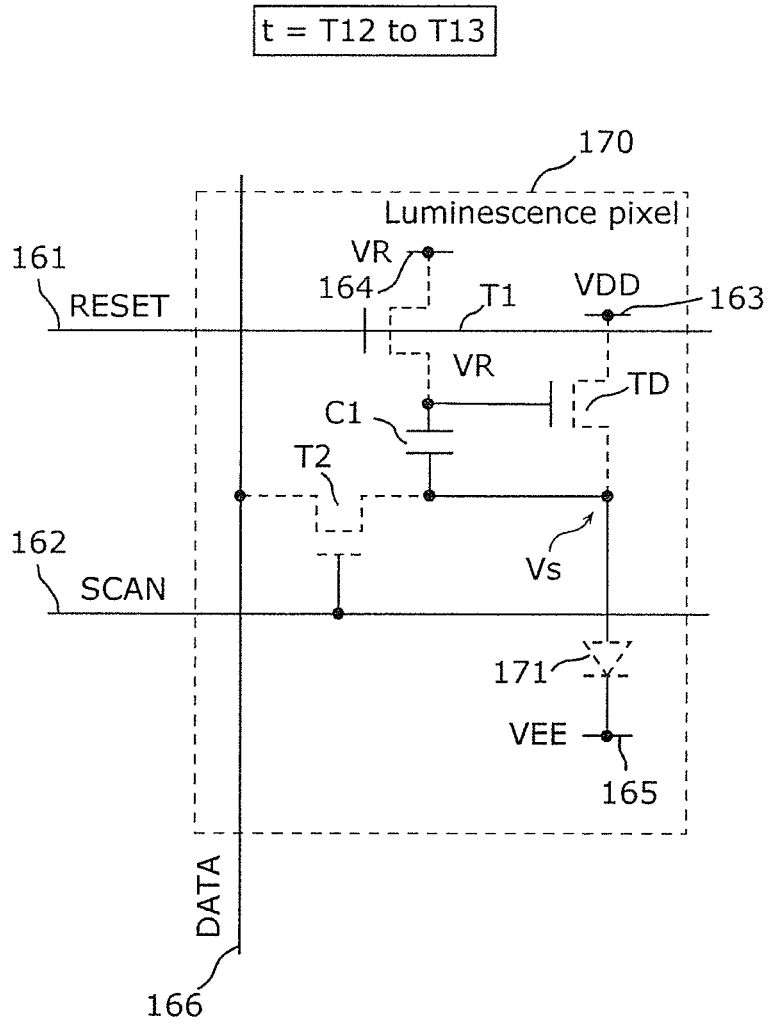
FIG. 5B is a circuit diagram schematically showing the state of the luminescence pixel in t=T12 to T13.

FIG. 5B is a circuit diagram schematically showing the state of the luminescence pixel in the period t=T12 to T13.

As shown in the figure, with the turning OFF of the first switching transistor T1 and the second switching transistor T2, there is no conduction between the first electrode of the capacitor C1 and the reference power line 164, and thus there is no conduction between the second electrode of the capacitor C1 and the data line 166. Therefore, as described above, the voltage VR−Vreset is held in the capacitor C1. In other words, because the potential of the respective electrodes, namely, the gate, source, and drain, of the drive transistor TD are all held at an approximately constant potential in the reset period, the reset becomes a more clearly defined state. Specifically, the gate potential, the source potential, and the drain potential are instantaneously set to VR, Vreset, and VDD, respectively.

Next, at t=T13, the scanning line drive circuit 120 causes the first switching transistor T1 to turn ON by switching the reset pulse RESET from the low level to the high level (step S14 in FIG. 4). With this, there is conduction between (i) the first electrode of the capacitor C1 and the gate electrode of the drive transistor TD and (ii) the reference power source line 164, and thus the potential of the first electrode of the capacitor C1 becomes the reference voltage VR.

Simultaneously, at the time t=T13, the scanning line drive circuit 120 causes the second switching transistor T2 to turn ON by switching the scanning pulse SCAN from the low level to the high level. With this, the potential of the source electrode of the drive transistor TD and the second electrode of the capacitor C1 are set to the signal voltage Vdata+δV (step S15 in FIG. 4). Therefore, a desired voltage VR−Vdata−δV corresponding to the signal voltage Vdata is written into the capacitor C1. In other words, steps S14 and S15 in FIG. 4 constitute a writing process of the luminescence pixel 170.

In a period t=T13 to T14, the reset pulse RESET is at the high level, and thus the reference voltage VR is continuously applied to the first electrode of the capacitor C1 and the gate electrode of the drive transistor TD. Furthermore, since the scanning pulse SCAN is at the high level, the signal voltage Vdata is continuously applied to the second electrode of the capacitor C1 and the source electrode of the drive transistor TD.

Figure 5C:
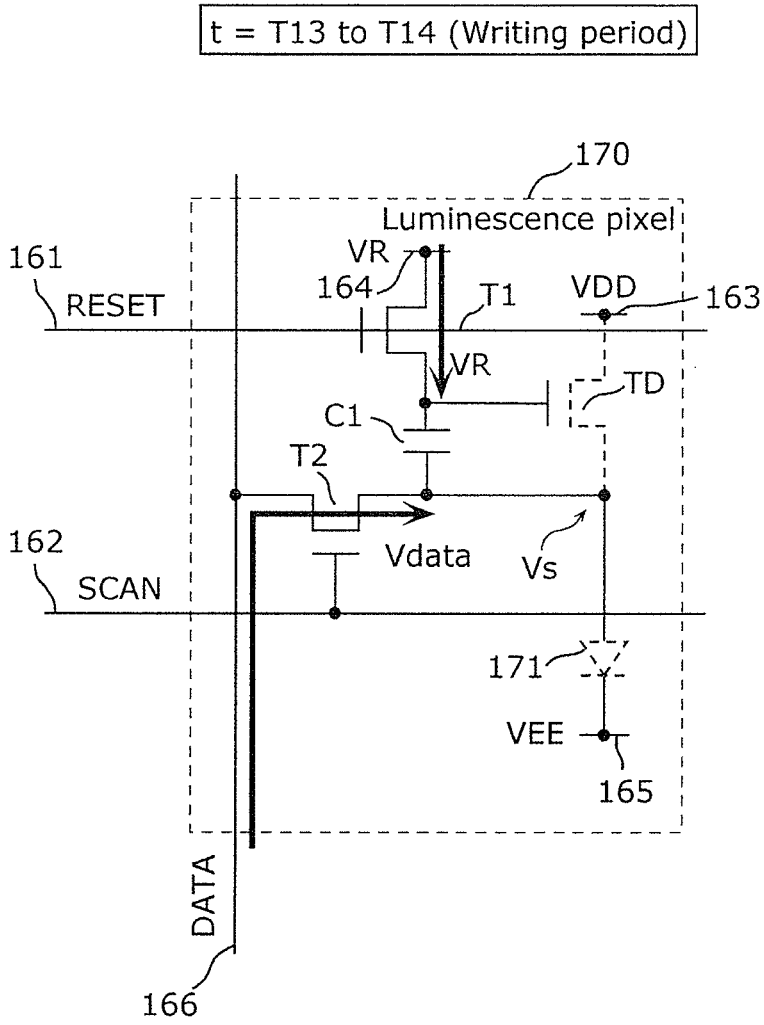
FIG. 5C is a circuit diagram schematically showing the state of the luminescence pixel in t=T13 to t14.

FIG. 5C is a circuit diagram schematically showing the state of the luminescence pixel in the period t=T13 to t14.

As shown in the figure, the reference voltage VR is applied from the reference power source line 164 to the first electrode of the capacitor C1 and the gate electrode of the drive transistor TD via the first switching transistor T1, and the voltage Vdata+δV corresponding to the signal voltage Vdata is applied from the data line 166 to the source electrode of the drive transistor TD and the second electrode of the capacitor C1 via the second switching transistor T2.

Next, at the time t=T14, the scanning line drive circuit 120 causes the first switching transistor T1 to turn OFF by switching the scanning pulse SCAN from the high level to the low level. Furthermore, at the same time, the scanning line drive circuit 120 causes the second switching transistor T2 to turn OFF by switching the reset pulse RESET from the high level to the low level (step S16 in FIG. 4).

With this, there is no conduction between the first electrode of the capacitor C1 and the reference power source line 164. Furthermore, there is no conduction between the second electrode of the capacitor C1 and the data line 166. Therefore, the desired voltage VR−Vdata−δV corresponding to the signal voltage Vdata is held in the capacitor C1.

Furthermore, the drive transistor TD generates a drain current corresponding to the potential difference between the gate electrode and source electrode of the drive transistor TD. Specifically, the drive transistor TD causes the luminescence element 171 to produce luminescence at a luminescence production luminance corresponding to the signal voltage Vdata by supplying, to the luminescence element 171, the drain current corresponding to the desired voltage VR−Vdata−δV held in the capacitor C1. In other words, steps S16 in FIG. 4 constitutes a luminescence production process of the luminescence pixel 170.

In this manner, by turning ON the first switching transistor T1, the reference voltage VR which defines the voltage value of the gate electrode for stopping the drain current of the drive transistor TD is supplied to the first electrode of the capacitor C1. Accordingly, since the luminescence element 171 is placed in the OFF state, the second switching transistor T2 is turned ON in such state, thus causing the desired voltage VR−Vdata−δV to be held in the capacitor C1.

Therefore, according to the control method up to this point, in the display device 100, the potential difference between the gate electrode and the source electrode of the drive transistor TD is set to the voltage VR−Vreset which is the difference voltage between the reference voltage VR and the reset voltage Vreset, up to the time t=T13. Subsequently, at t=T13, the potential difference between the gate electrode and source electrode of the drive transistor TD is set to the desired voltage VR−Vdata−δV. Specifically, since the desired voltage is held in the capacitor C1 in the state in which the potential difference between the gate electrode and the source electrode of the drive transistor TD is reset, it is possible to stabilize the luminescence production amount of the luminescence element 171 which corresponds to the signal voltage Vdata, without being affected by the hysteresis of the voltage-current characteristics of the drive transistor TD. Therefore, in the display device 100, it is possible to prevent the occurrence of an afterimage due to the hysteresis in the voltage-current characteristics of the drive transistor TD.

In a period t=T14 to T15, the scanning line drive circuit 120 has the reset pulse RESET and the scanning pulse SCAN at the low level, and thus the voltage VR−Vdata−δV is continuously held in the capacitor C1. Therefore, the drive transistor TD continues to supply the luminescence element 171 with a drain current corresponding to the voltage VR−Vdata held in the capacitor C1. Therefore, the luminescence element 171 continues to produce luminescence.

Figure 5D:
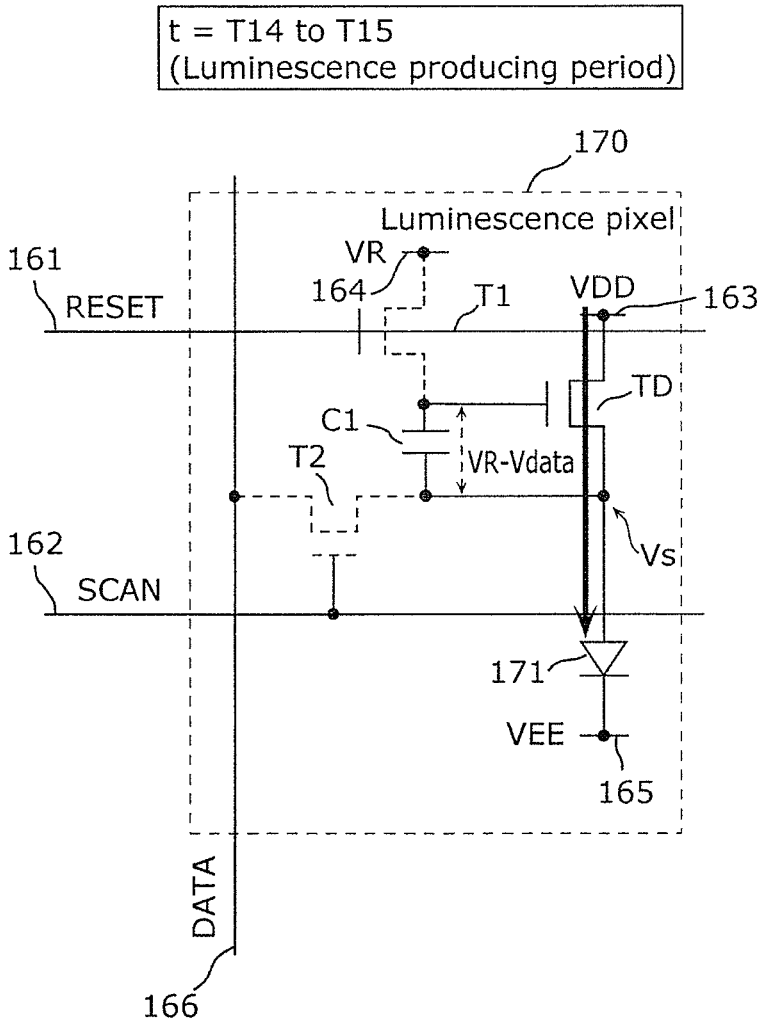
FIG. 5D is a circuit diagram schematically showing the state of the luminescence pixel in t=T14 to T15.

FIG. 5D is a circuit diagram schematically showing the state of the luminescence pixel in the period t=T14 to T15.

As shown in the figure, the capacitor C1 holds the voltage VR−Vdata, and the drive transistor TD supplies the luminescence element 171 with the drain current corresponding to the voltage held in the capacitor C1.

Next, in the same manner as in t=T11, at the time t=T15, the scanning line drive circuit 120 causes the first switching transistor T1 to turn ON by switching the reset pulse RESET from the low level to the high level, so that the reference voltage VR is supplied to the gate electrode of the drive transistor TD. At the same time, the scanning line drive circuit 120 causes the second switching transistor T2 to turn OFF by switching the scanning pulse SCAN from the low level to the high level, so that the reset voltage Vreset is supplied to the source electrode of the drive transistor TD. With this, the luminescence element 171 is optically-quenched, and the potential of the source electrode of the drive transistor TD immediately transitions to the reset voltage Vreset.

The above described t=T11 to T15 is equivalent to 1 frame period of the display device 100, and after t=T15, the same operations as in t=T11 to T15 are also repeatedly executed.

As described above, according to the display device 100 according to the present embodiment, the first electrode of the capacitor C1 is connected to the gate electrode of the drive transistor TD, the second electrode of the capacitor C1 is connected to the data line 166 via the second switching transistor T2. In addition, in the display device 100 is provided with the first switching transistor T1 for supplying the gate electrode of the drive transistor TD with the reference voltage VR which defines the voltage value of the gate electrode for stopping the drain current of the drive transistor TD. Then, the scanning line drive circuit 120 causes the first switching transistor T1 to turn OFF so that the reference voltage VR is supplied to the gate electrode of the drive transistor TD. According to the voltage condition VR−Vth (TD) ≤Vreset≤data (max)≤VEE+Vth (EL), the luminescence element 171 is placed in the OFF state with respect to the voltage level of an arbitrary signal line. In the period in which such luminescence element 171 is in the OFF state, the second switching transistor T2 is turned ON so that the reset voltage Vreset is applied from the data line 166 to the connection point between the anode electrode of the luminescence element 171 and the source electrode of the drive transistor TD.

With this, the potential of the source electrode of the drive transistor TD and the anode electrode of the luminescence element 171 are instantaneously reset to the reset voltage Vreset. Specifically, in the period in which there is no conduction between the source electrode and drain electrode of the drive transistor TD, the reset voltage Vreset is applied to the connection point between the anode electrode of the luminescence element 171 and the source electrode of the drive transistor TD, thereby forcibly resetting the potentials of the source electrode of the drive transistor TD and the anode electrode of the luminescence element 171. Therefore, since the gate-source voltage of the drive transistor TD can be reset to the difference voltage between the reference voltage VR and the reset voltage Vreset, it is possible to effectively suppress the occurrence of an afterimage caused by the hysteresis in the voltage-current characteristics of the drive transistor TD.

Furthermore, the time up to when the source electrode of the drive transistor TD and the anode electrode of the luminescence element 171 start to reset can be adjusted using the timing for supplying the reset voltage Vreset to the second electrode of the capacitor C1 within the period for supplying the reference voltage VR to the first electrode of the capacitor C1. As such, it is possible to shorten the time up to when the potential of the source electrode of the drive transistor TD stabilizes to a constant potential. Stated differently, it is possible to shorten the time up to when the gate-source voltage of the drive transistor TD becomes a constant voltage. In other words, the gate-source voltage of the drive transistor TD can be held longer to a constant voltage by as much as the amount of time eliminated in such shortening. Therefore, the voltage-current characteristics of the drive transistor TD can be set to substantially the initial state. Therefore, it is possible to suppress the occurrence of an afterimage due to the transient state in which the voltage-current characteristics of the drive transistor TD transiently changes.

Furthermore, as described above, by being able to place the voltage-current characteristics of the drive transistor TD to substantially the initial state in a short time, the occurrence of an afterimage due to the voltage-current characteristics of the drive transistor TD can be suppressed even when the non-luminescence-producing period, which is the time from when the drain current of the drive transistor TD is stopped to when the drain current is supplied again, is set to be a shorter time than conventional.

Furthermore, as described above, by being able to place the voltage-current characteristics of the drive transistor TD to substantially the initial state in a short time, the occurrence of an afterimage due to the voltage-current characteristics of the drive element can be suppressed even when the non-luminescence-producing period, which is the time from when the drain current of the drive element is stopped to when the drain current is supplied again, is set to be a shorter time than conventional. Therefore, the luminescence producing period can be secured for a longer time.

In addition, the reference voltage VR is supplied to the first electrode of the capacitor C1 whereas the reset voltage Vreset is supplied to the second electrode of the capacitor C1. By setting the voltage condition as VR−Vth (TD)≤Vreset≤Vdata (max)≤VEE+Vth (EL), it is possible to set both the first electrode and the second electrode of the capacitor C1 to cause the capacitor C1 to hold a precise potential difference and cause a source grounding operation and at the same time secure the desired contrast.

Embodiment 2

A display device according to the present embodiment is nearly the same as the display device according to the Embodiment 1 but is different in being provided with a third switching element that is inserted between the first electrode of the luminescence element and the second electrode of the capacitor. Furthermore, the display device is different in that a drive circuit causes the capacitor to hold the desired voltage by causing the signal voltage to be applied to the second electrode of the capacitor by causing the second switching capacitor to turn ON while causing the third switching element to turn OFF in the signal voltage writing period, and then causes the first switching element and the second switching element to turn OFF after causing the desired voltage to be held in the capacitor, and then causes the third switching element to turn ON after causing the first switching element and the second switching element to turn OFF.

With this, in the display device according to the present embodiment, it is possible to prevent the fluctuation of the potential of the second electrode of the capacitor caused by current flowing into the second switching element via the drive element when writing the signal voltage to the second electrode of the capacitor. Therefore, it is possible to cause a precise voltage corresponding to the luminance that corresponds to the image signal inputted to the display device from an outside source to be held in the capacitor. Therefore, high-precision image display can be realized.

Hereinafter, Embodiment 2 of the present invention shall be specifically described with reference to the Drawings.

Figure 6:
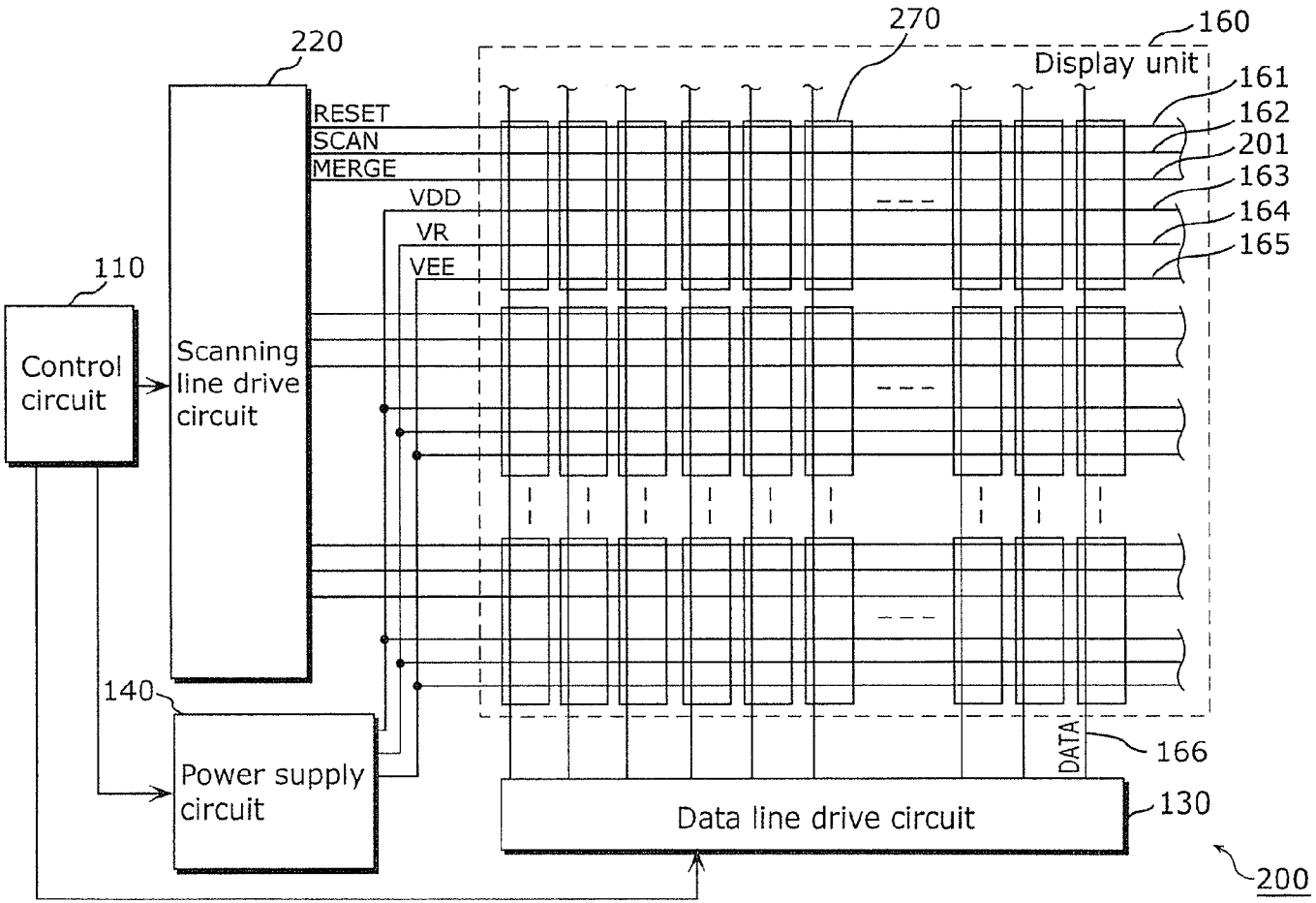
FIG. 6 is a block diagram showing an electrical configuration of a display device according to Embodiment 2.

FIG. 6 is a block diagram showing an electrical configuration of the display device according to the present embodiment.

Compared to the display device 100 according to Embodiment 1 shown in FIG. 1, a display device 200 shown in the figure further includes merge lines 201 each provided for one column of luminescence pixels 270, and the operation of a scanning line drive circuit 220 is different from that of the scanning line drive circuit 120.

Figure 7:
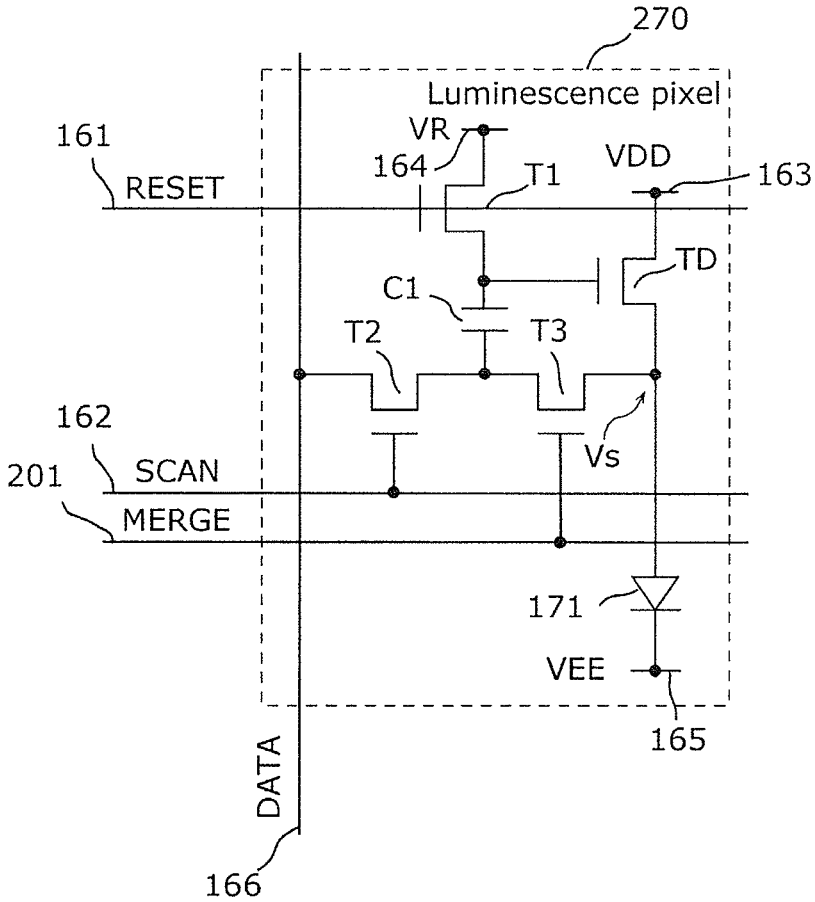
FIG. 7 is a circuit diagram showing a detailed circuit configuration of a luminescence pixel.

Furthermore, FIG. 7 is a circuit diagram showing a circuit configuration of a luminescence pixel in the display device 200 according to the present embodiment.

A luminescence pixel 270 shown in the figure is nearly the same as the luminescence pixel 170 shown in FIG. 2 but further includes a third switching transistor T3 inserted between the anode electrode of the luminescence element 171 and the second electrode of the capacitor C1.

Compared to the scanning line drive circuit 120 in the display device 100 according to Embodiment 1, the scanning line drive circuit 220 is further connected to merge lines 201 and controls the third switching transistors T3 on a row basis by supplying, to the respective merge lines 201, a merge pulse Merge which is a signal for controlling the turning ON and OFF of the third switching transistor T3.

The third switching transistor T3 has: one of a source electrode and a drain electrode connected to the anode electrode of the luminescence element 171; the other of the source and the drain electrode connected to the second electrode of the capacitor C1; and a gate electrode connected to the merge line 201. The third switching transistor T3 is turned ON and OFF according to the merge pulse MERGE that is supplied from the scanning line drive circuit 220 via the merge line 201. For example, the third switching transistor T3 is an n-type thin film transistor (TFT), and is turned ON in the period in which the merge pulse MERGE is at the high level such that there is conduction between the second electrode of the capacitor C1 and the source electrode of the drive transistor TD.

Figure 8:
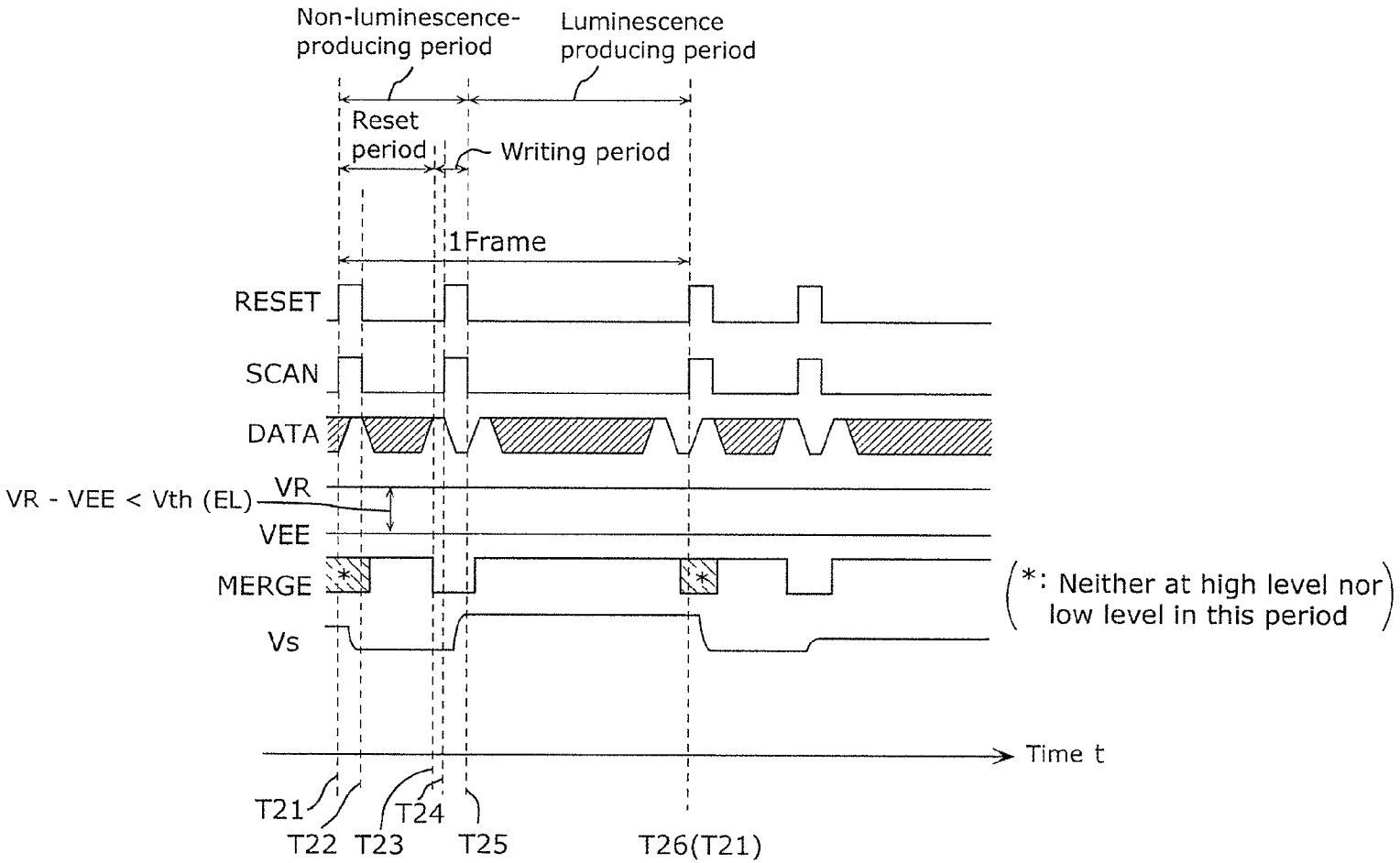
FIG. 8 is an operation timing chart for describing a method of controlling the display device.

Next, a method of driving the above-described display device 200 shall be described using FIG. 8 to FIG. 10E. FIG. 8 is an operation timing chart for describing a method of controlling the display device 200 according to the present embodiment. Compared to the operation timing chart shown in FIG. 3, the figure further shown the waveform chart of the merge pulse MERGE.

Figure 9:
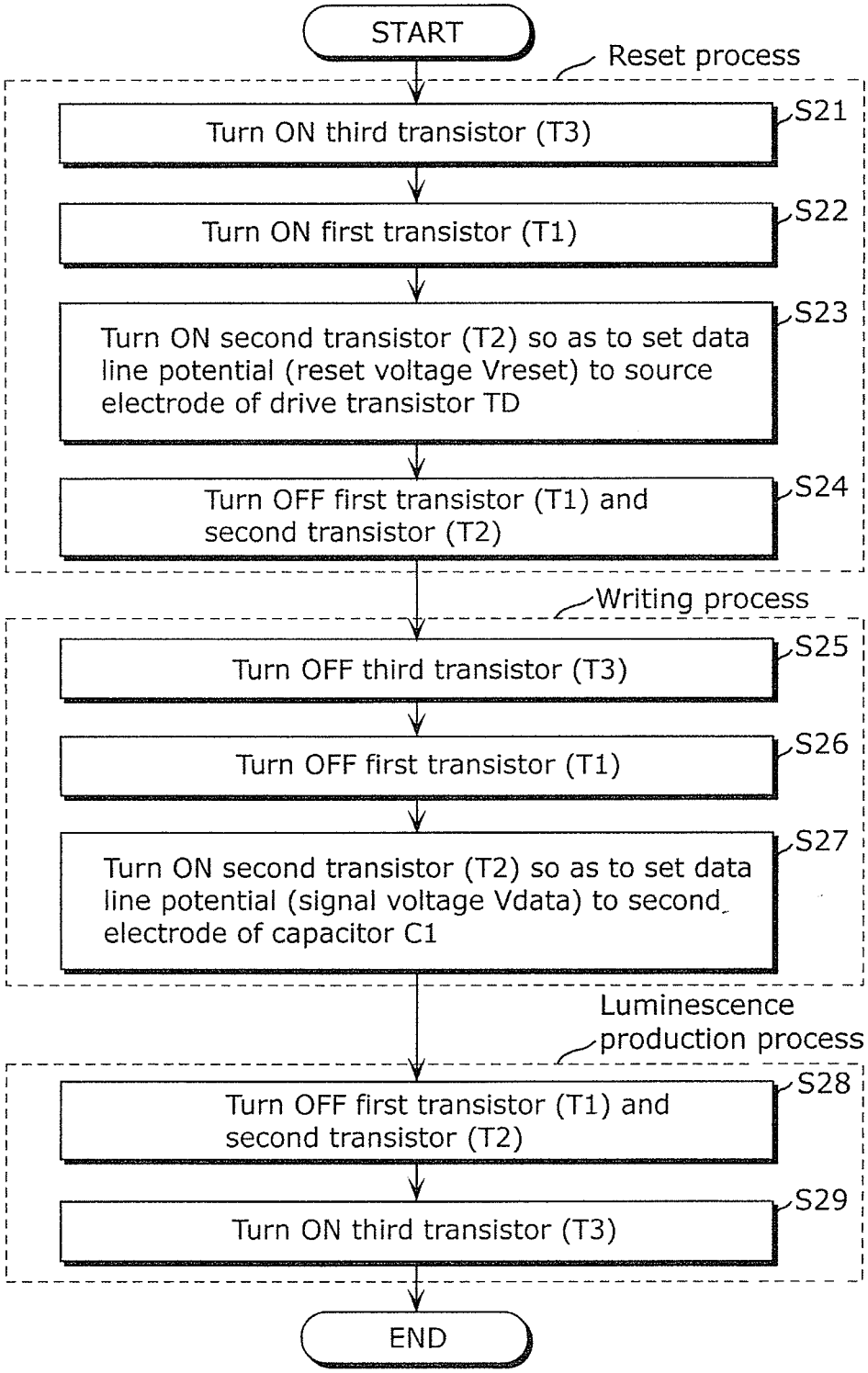
FIG. 9 is an operation flowchart for describing the method of controlling the display device.

Furthermore, FIG. 9 is an operation flowchart for describing the method of controlling the display device 200 according to the present embodiment.

First, at a time t=T21, the scanning line drive circuit 220 causes the third switching transistor T3 to turn ON while preferably holding the merge pulse MERGE at the high level (step S21 in FIG. 9). Therefore, there is conduction between the second electrode of the capacitor C1 and the anode electrode of the luminescence element 171. In other words, at this time, circuit of the display device 200 is equivalent to the circuit of the display device 100. Therefore, the operation of the display device 200 at t=T21 is the same as the operation of the display device 100 in t=11 shown in FIG. 3.

Specifically, at t=T21, the scanning line drive circuit 220 causes the first switching transistor T1 to turn ON by switching the reset pulse RESET from the low level to the high level (step S22 in FIG. 9). With this, there is conduction between (i) the reference power source line 164 and (ii) the first electrode of the capacitor C1 and the gate electrode of the drive transistor TD, and thus the voltage of the first electrode of the capacitor C1 and the gate electrode of the drive transistor TD becomes the reference voltage VR.

Simultaneously, at the time t=T21, the scanning line drive circuit 220 causes the second switching transistor T2 to turn ON by switching the scanning pulse SCAN from the low level to the high level. With this there is conduction between the source electrode of the drive transistor TD and the data line 166, and thus the reset voltage Vreset is set to the source electrode of the drive transistor TD (step S23 in FIG. 9). Furthermore, by turning ON the second switching transistor T2, there is also conduction between the second electrode of the capacitor C1 and the data line 166 such that the reset voltage Vreset is set to the capacitor C1.

In the period t=T21 to T22, the reset pulse RESET is at the high level, and thus the reference voltage VR is continuously applied to the first electrode of the capacitor C1 and the gate electrode of the drive transistor TD. Furthermore, since the scanning pulse SCAN is at the high level, the reset voltage Vreset is continuously applied to the second electrode of the capacitor C1. Furthermore, since the merge pulse MERGE is at the high level, the reset voltage Vreset is continuously applied to the source electrode of the drive transistor TD.

Figure 10A:
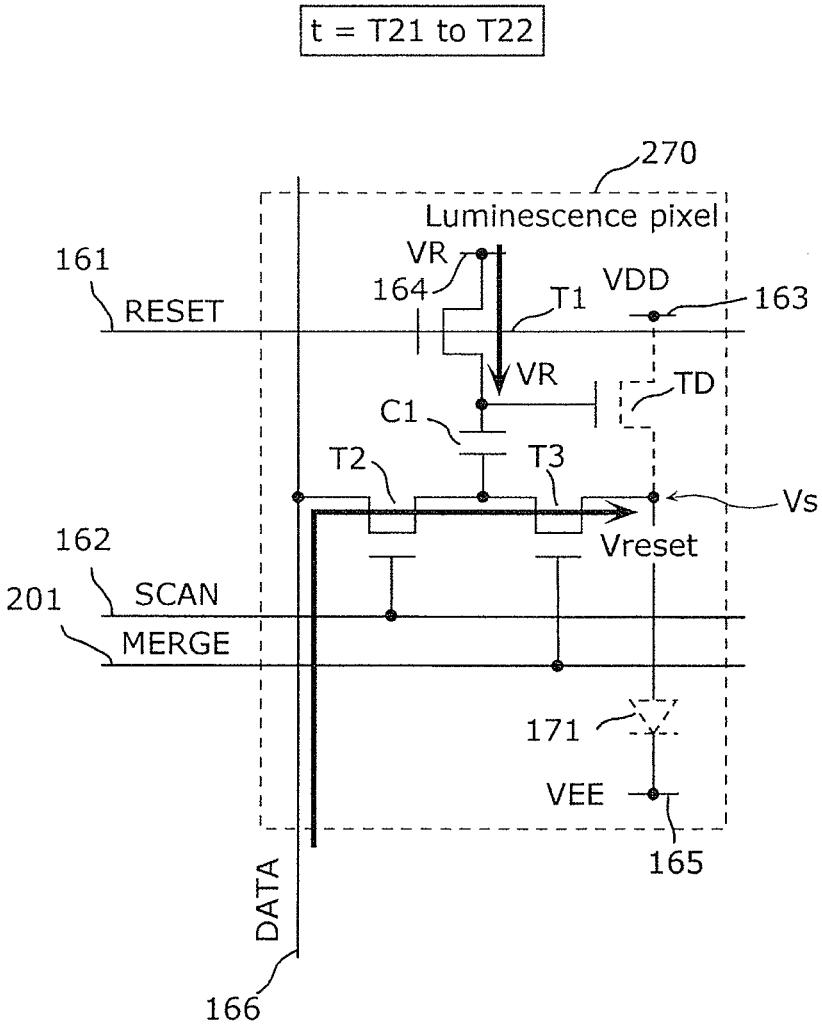
FIG. 10A is a circuit diagram schematically showing the state of a luminescence pixel in t=T21 to T22.

FIG. 10A is a circuit diagram schematically showing the state of the luminescence pixel in the period t=T21 to T22.

As shown in the figure, there is conduction between the second electrode of the capacitor C1 and the source electrode of the drive transistor TD via the third switching transistor T3. Therefore, the state of the luminescence pixel 270 is equivalent to the state of the luminescence pixel 170 in the period t=T11 to T12 shown in FIG. 5A. Specifically, in the period t=T21 to T22, the drain current of the drive transistor TD is caused to stop by turning ON the first switching transistor T1 so that the reference voltage VR is supplied to the gate electrode of the drive transistor TD. Furthermore, by turning ON the second switching transistor T2 and the third switching element T3, the predetermined reset voltage Vreset from the data line 166 is applied to the connection point between the anode electrode of the luminescence element 171 and the source electrode of the drive transistor TD.

With this, the potential Vs of the source electrode of the drive transistor TD in the display device 200 according to Embodiment 2 immediately transitions from the signal voltage Vdata of the immediately preceding frame to the reset voltage Vreset, in the same manner as in the display device 100 according to Embodiment 1. Therefore, in the same manner as in the display device 100 according to Embodiment 1, the reset valid period can be lengthened in the display device 200 according to the present embodiment compared to the conventional display device. Here, contrast deteriorates when current flows to the luminescence element 171 such that luminescence is produced during the reset period, and thus it is preferable that luminescence is not produced. Specifically, since VR is a voltage which causes the drive transistor TD to turn OFF, it is preferable that the voltage condition be set as $VR-VEE \leq Vth\ (TD)+Vth\ (EL)$.

Next, at the time t=T22, the scanning line drive circuit 220 causes the first switching transistor T1 to turn OFF by switching the reset pulse RESET from the high level to the low level. Furthermore, the scanning line drive circuit 220 causes the second switching transistor T2 to turn OFF by switching the scanning pulse SCAN from the high level to the low level (step S24 in FIG. 9). At this time, the scanning line drive circuit 220 continues to cause the third switching transistor T3 to be ON by continuously keeping the merge pulse MERGE at the high level. With this, the capacitor C1 holds VR−Vreset which is the potential difference between the reference voltage VR applied to the first electrode until just before, and the reset voltage Vreset applied to the second electrode until just before, in the same manner as in the state of the display device 100 in t=T12. It should be noted that the steps S21 to S24 in FIG. 9 up to this point constitute a reset process of the luminescence pixel 270.

Since the reset pulse RESET and the scanning pulse SCAN are at the low level in the period t=T22 to T23, the capacitor C1 continues to hold the voltage VR−Vreset. Furthermore, since the merge pulse MERGE is at the high level, there is conduction between the second electrode of the capacitor C1 and the source electrode of the drive transistor TD via the third switching transistor T3. Therefore, the state of the luminescence pixel 270 is equivalent to the state of the luminescence pixel 170 in t=T12 to T13 shown in FIG. 5B. Therefore, the voltage VR−Vreset is held in the capacitor C1.

It should be noted that although, as described above, the circuit operation for the case where the merge pulse MERGE is kept at the high level in t=T21 to T22 is described here, a reset period can also be provided even when the merge pulse MERGE is at the low level in t=T21 to T22, and the advantageous effect of the present invention can be obtained. Specifically, when the merge pulse MERGE is kept at the low level in t=T21 to T22, there is no conduction between the source electrode of the drive transistor TD and the second electrode of the capacitor C1. With this, the reference voltage VR is supplied to the gate electrode of the drive transistor TD such that the drain current of the drive transistor TD is stopped, and thus the potential Vs of the source electrode of the drive transistor TD approaches Vth (EL) due to the self-discharge of the luminescence element 171. As such, in this case, the potential Vs of the source electrode of the drive transistor TD does not transition from the signal voltage Vdata of the immediately preceding frame to the reset voltage Vreset. However, since the reference voltage VR is supplied to the gate electrode of the drive transistor TD and a predetermined reset voltage Vreset is supplied to the second electrode of the capacitor C1, the potential of both electrodes of the capacitor C1 becomes fixed. Therefore, in t=T23 described later, the gate-source voltage of the drive transistor TD can be instantaneously reset to the difference voltage between the reference voltage VR and the reset voltage Vreset by turning ON the third switching transistor T3.

Figure 10B:
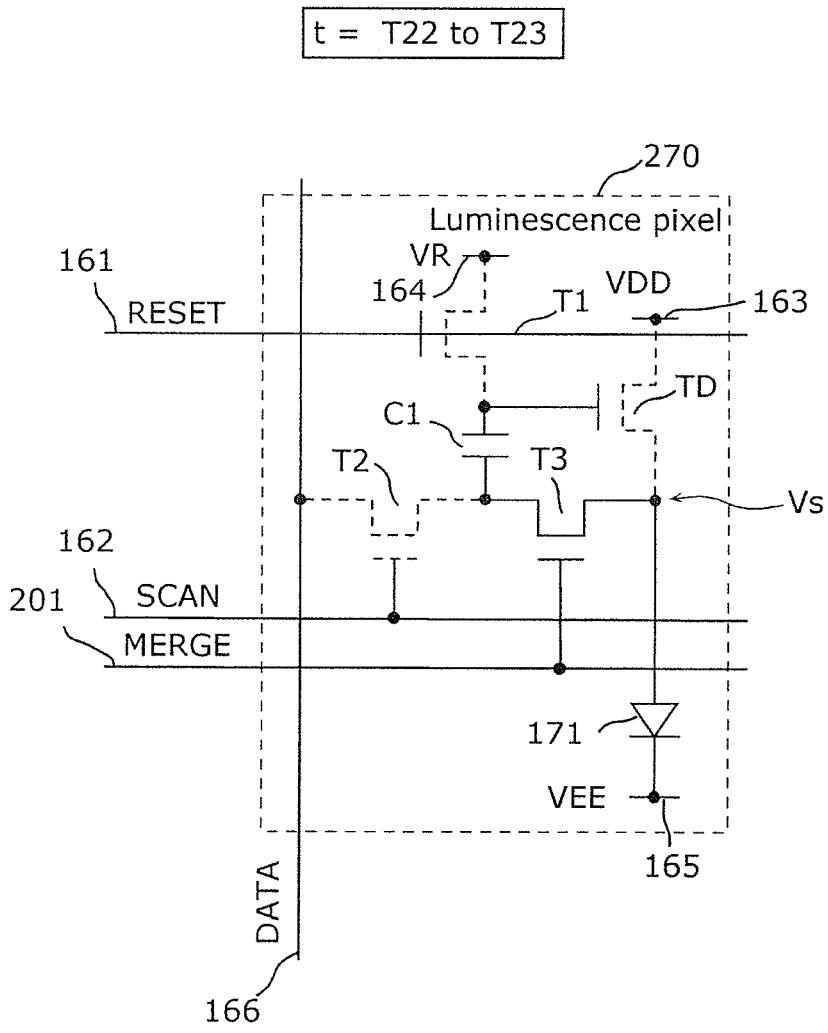
FIG. 10B is a circuit diagram schematically showing the state of the luminescence pixel in t=T22 to T23.

FIG. 10B is a circuit diagram schematically showing the state of the luminescence pixel in the period t=T22 to T23.

As shown in the figure, by turning ON the third switching transistor T3, there is continuous conduction between the second electrode of the capacitor C1 and the source electrode of the drive transistor TD. Therefore, the state of the luminescence pixel 270 is equivalent to the state of the luminescence pixel 170 in t=T12 to T13 shown in FIG. 5B. In other words, the voltage VR−Vreset is held in the capacitor C1, and the source potential of the drive transistor TD is Vreset.

Next, at the time t=T23, the scanning line drive circuit 220 causes the third switching transistor T3 to turn OFF by switching the merge pulse MERGE from the high level to the low level (step S25 in FIG. 9). With this, there is no conduction between the second electrode of the capacitor C1 and the source electrode of the drive transistor TD.

Figure 10C:
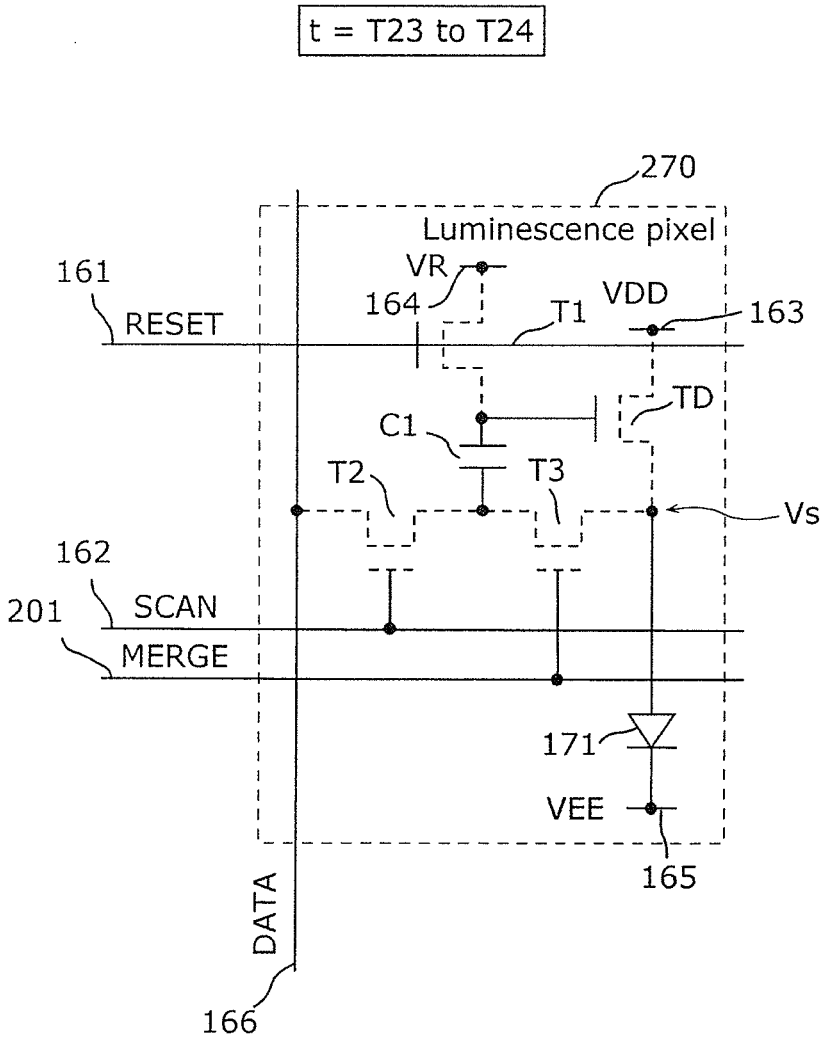
FIG. 10C is a circuit diagram schematically showing the state of the luminescence pixel in t=T23 to T24.

FIG. 10C is a circuit diagram schematically showing the state of the luminescence pixel in the period t=T23 to T24.

Since the merge pulse MERGE is at the low level in the period t=T23 to T24, the third switching transistor T3 is continuously turned OFF, and thus, in this period, there continues to be no conduction between the second electrode of the capacitor C1 and the source electrode of the drive transistor TD.

Next, at the time t=T24, the scanning line drive circuit 220 causes the first switching transistor T1 to turn ON by switching the reset pulse RESET from the low level to the high level (step S26 in FIG. 9). With this, there is conduction between (i) the first electrode of the capacitor C1 and the gate electrode of the drive transistor TD and (ii) the reference power source line 164, and thus the potential of the first electrode of the capacitor C1 becomes the reference voltage VR.

Simultaneously, at the time t=T24, the scanning line drive circuit 220 causes the second switching transistor T2 to turn ON by switching the scanning pulse SCAN from the low level to the high level. With this, the potential of the second electrode of the capacitor C1 is set to the signal voltage Vdata (step S27 in FIG. 9). In other words, steps S25 and S27 in FIG. 9 constitute a writing process of the luminescence pixel 270.

In the period t=T24 to T25, the reset pulse RESET is at the high level, and thus the reference voltage VR is continuously applied to the first electrode of the capacitor C1 and the gate electrode of the drive transistor TD. Furthermore, since the scanning pulse SCAN is at the high level, the signal voltage Vdata is continuously applied to the second electrode of the capacitor C1. Furthermore, since the merge pulse MERGE is at the low level, there is no conduction between the source electrode of the drive transistor TD and the second electrode of the capacitor C1.

Figure 10D:
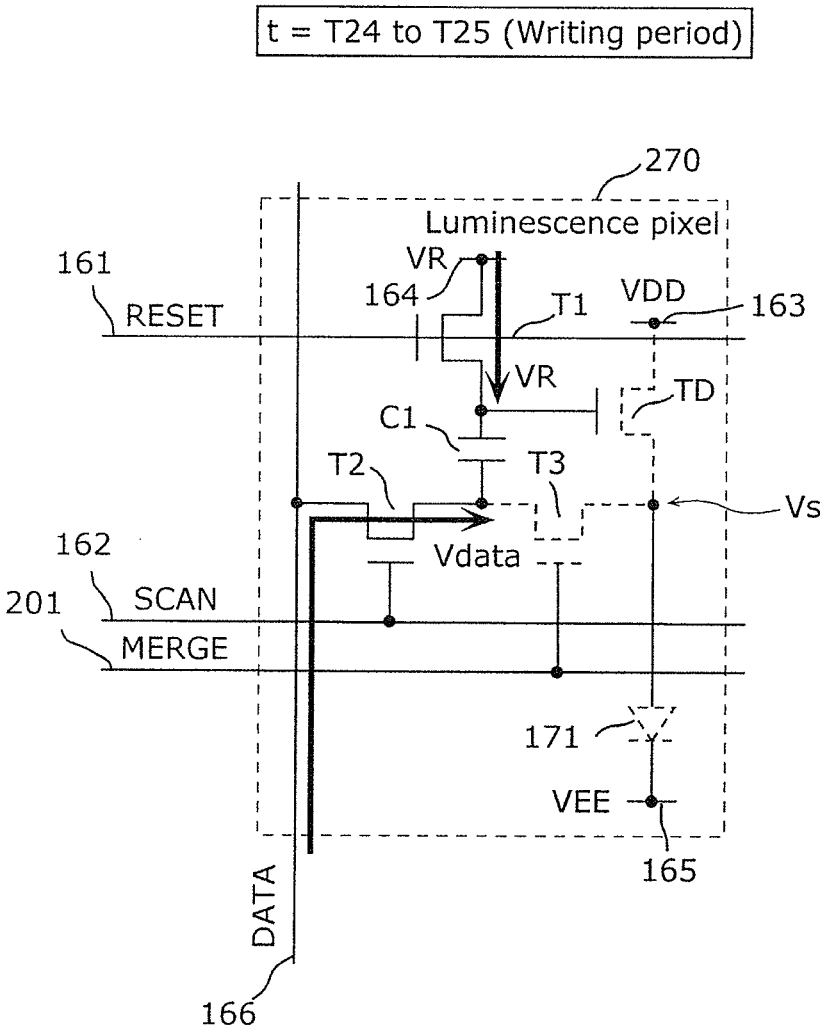
FIG. 10D is a circuit diagram schematically showing the state of the luminescence pixel in t=T24 to T25.

FIG. 10D is a circuit diagram schematically showing the state of the luminescence pixel in the period t=T24 to T25.

As shown in the figure, the reference voltage VR is applied to the first electrode of the capacitor C1 and the gate electrode of the drive transistor TD from the reference power source line 164 via the first switching transistor T1, and the voltage Vdata is applied to the second electrode of the capacitor C1 from the data line 166 via the second switching transistor T2. On the other hand, there is no conduction between the source electrode of the drive transistor TD and either of the drain electrode of the drive transistor TD and the second electrode of the capacitor C1.

The display device 200 according to the present embodiment is different from the display device 100 according to Embodiment 1 in terms of the state of the luminescence pixel in the period t=T24 to T25. Specifically, in the display device 200, the flow of drain current to the second switching transistor T2 via the drive transistor TD is prevented by causing the third switching transistor T3 to turn OFF during the writing of the signal data Vdata into the luminescence pixel 270. With this, fluctuation in the potential of the second electrode of the capacitor C1 can be prevented. Therefore, in the present embodiment, the voltage VR−Vdata can be precisely held in the capacitor C1. As a result, in the display device 200, it is possible to cause the luminescence element 171 to produce luminescence precisely at the luminescence production amount corresponding to the voltage VR−Vdata, in the next luminescence producing period.

Next, at the time t=T25, the scanning line drive circuit 220 causes the first switching transistor T1 to turn OFF by switching the scanning pulse SCAN from the high level to the low level. Furthermore, at the same time, the scanning line drive circuit 220 causes the second switching transistor T2 to turn OFF by switching the reset pulse RESET from the high level to the low level (step S28 in FIG. 9). With this, there is no conduction between the first electrode of the capacitor C1 and the reference power source line 164. Furthermore, there is no conduction between the second electrode of the capacitor C1 and the data line 166. Therefore, the desired voltage VR−Vdata corresponding to the signal voltage Vdata is held in the capacitor C1.

Furthermore, at a time t=T25, the scanning line drive circuit 220 causes the third switching transistor T3 to turn ON by switching the merge pulse MERGE from the low level to the high level, immediately after switching the reset pulse RESET and the scanning pulse SCAN from the high level to the low level (step S29 in FIG. 9). With this, there is conduction between the second electrode of the capacitor C1 and the source electrode of the drive transistor TD. Specifically, the voltage VR−Vdata is precisely applied between the gate electrode and the source electrode of the drive transistor TD. Therefore, the drive transistor TD causes the luminescence element 171 to produce luminescence precisely at the luminescence production amount corresponding to the signal voltage Vdata, by supplying the luminescence element 171 with a drain current corresponding to the voltage VR−Vdata. In other words, steps S28 and S29 in FIG. 9 constitute the luminescence production process of the luminescence pixel 270.

Furthermore, by switching the merge pulse MERGE from the low level to the high level immediately after switching the reset pulse RESET and the scanning pulse SCAN from the high level to the low level as described above, the display device 200 is capable of securing the luminescence producing period to the maximum extent.

Since the reset pulse RESET and the scanning pulse SCAN are at the low level and the merge pulse MERGE is at the high level in the period t=T25 to T26, the voltage VR−Vdata continues to be precisely held in the capacitor C1. Therefore, the drive transistor TD continues to supply the luminescence element 171 with the drain current corresponding to the voltage VR−Vdata precisely held in the capacitor C1. Therefore, the luminescence element 171 continues to produce luminescence at the luminescence production amount precisely corresponding to the signal data Vdata.

Figure 10E:
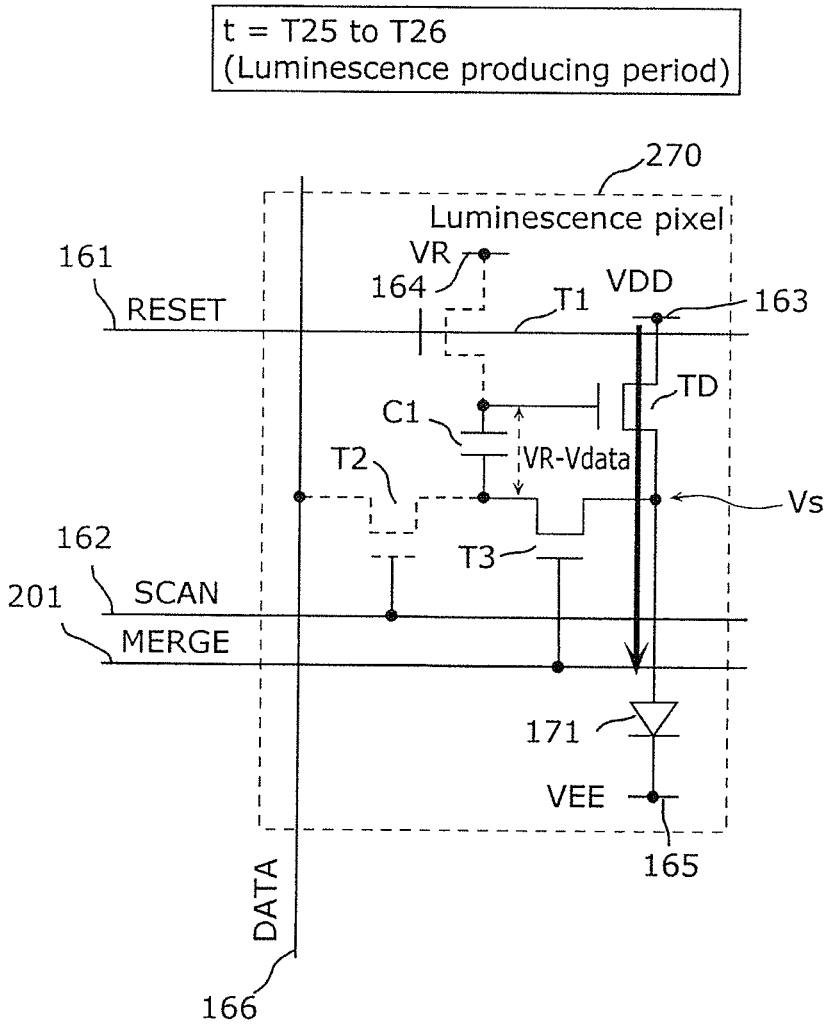
FIG. 10E is a circuit diagram schematically showing the state of the luminescence pixel in t=T25 to T26.

FIG. 10E is a circuit diagram schematically showing the state of the luminescence pixel in the period t=T25 to T26.

As shown in the figure, the capacitor C1 precisely holds the voltage VR−Vdata, and the drive transistor TD supplies the luminescence element 171 with the drain current corresponding to the voltage held in the capacitor C1.

Next, at the time t=T26, the scanning line drive circuit 220 causes the first switching transistor T1 to turn ON by switching the reset pulse RESET from the low level to the high level, so that the reference voltage VR is supplied to the gate electrode of the drive transistor TD. At the same time, the scanning line drive circuit 220 causes the second switching transistor T2 to turn OFF by switching the scanning pulse SCAN from the low level to the high level, so that the reset voltage Vreset is supplied to the source electrode of the drive transistor TD. With this, the luminescence element 171 is optically-quenched, and the potential of the source electrode of the drive transistor TD immediately transitions to the reset voltage Vreset.

The above described t=T21 to T26 is equivalent to 1 frame period of the display device 200, and after t=T26, the same operations as in t=T21 to T26 are also repeatedly executed.

As described above, the display device 200 according to the present embodiment (i) is provided with the third switching transistor which controls the connection between the anode electrode of the luminescence element 171 and the second electrode of the capacitor C1 by being inserted between the anode electrode of the luminescence element 171 and the second electrode of the capacitor C1, and (ii) causes the desired voltage VR−Vdata corresponding to the signal voltage Vdata to be held in the capacitor C1 while the third switching transistor T3 is turned OFF, and (iii) turns ON the third switching transistor T3 after the desired voltage VR−Vdata is held in the capacitor C1. With this, the desired voltage VR−Vdata corresponding to the signal voltage Vdata can be set to the capacitor C1 in a state where current does not flow between the source electrode of the drive transistor TD and the second electrode of the capacitor C1. In other words, it is possible to prevent the fluctuation of the potential of the second electrode of the capacitor C1 caused by current flowing into the second switching transistor T2 via the drive transistor TD before the desired voltage VR−Vdata is held in the capacitor C1. As such, since the desired voltage VR−Vdata is caused to be precisely held in the capacitor C1, it is possible to prevent the voltage intended to be held in the capacitor C1 from fluctuating such that the luminescence element does not produce luminescence precisely at the luminescence production amount reflecting the image signal. As a result, in the display device 200, it is possible to cause the luminescence element 171 to produce luminescence precisely at the luminescence production amount corresponding to the signal voltage Vdata, and realize high-precision image display. Specifically, in the display device 200, it is possible to cause a precise voltage corresponding to the luminance that corresponds to the image signal inputted to the display device 200 from an outside source to be held in the capacitor C1, and thus high-precision image display can be realized.

Accordingly, it is possible to achieve the function (pixel stopping function) for stopping the drain current of the drive transistor TD by using the first switching transistor T1 for supplying the drive transistor TD with the reference voltage VR which defines the voltage value of the gate electrode for stopping the drain current of the drive transistor TD, and thus solve the problem of hysteresis in the voltage-current characteristics of the drive element using a simple configuration, and it is possible to cause the desired voltage VR−Vdata to be precisely held in the capacitor C1 by using the third switching transistor T3 which controls the connection between the source electrode of the drive transistor TD and the second electrode of the capacitor C1.

It should be noted that the display device in the present invention is not limited to the above-described embodiments. Modifications that can be obtained by executing various modifications to Embodiments 1 and 2 that are conceivable to a person of ordinary skill in the art without departing from the essence of the present invention, and various devices in which the display device according to the present invention are provided therein are included in the present invention.

Furthermore, although the first to third switching transistors and the drive transistor are described as being n-type transistors in the above-described embodiments, they may be configured of N-type transistors, and the polarity of the reset lines 161, the scanning lines 162, and the merge lines 201 may be reversed.

Furthermore, although the first to third switching transistors and the drive transistor are TFTs, they may be a different kind of field-effect transistor.

Furthermore, the display devices 100 and 200 according to the respective embodiments described above are typically implemented as a single LSI which is an integrated circuit. It is to be noted that part of the processing units included in the display devices 100 and 200 can also be integrated in the same substrate as the luminescence pixels 170 and 270. Furthermore, they may be implemented as a dedicated circuit or a general-purpose processor. Furthermore, a Field Programmable Gate Array (FPGA) which allows programming after LSI manufacturing or a reconfigurable processor which allows reconfiguration of the connections and settings of circuit cells inside the LSI may be used.

Furthermore, part of the functions of the scanning line drive circuit, the data line drive circuit, and the control circuit which are included in the display devices 100 and 200 according to the embodiments of the present invention may be implemented by having a processor such as a CPU execute a program. Furthermore, the present invention may also be implemented as a method of driving a display device which includes the characteristic steps implemented through the scanning line drive circuit described above.

Furthermore, although the foregoing descriptions exemplify the case where the display devices 100 and 200 are active matrix-type organic EL display devices, the present invention may be applied to organic EL display devices other than the active matrix-type, and may be applied to a display device other than an organic EL display device using a current-driven luminescence element, such as a liquid crystal display device.

Furthermore, although the timing for switching the reset pulse RESET from the low level to the high level and the timing for switching the scanning pulse SCAN from the low level to the high level are simultaneous in t=T11 in FIG. 3 and t=T21 in FIG. 8, the advantageous effect of the present invention can be obtained as long as the scanning pulse SCAN is switched from the low level to the high level in the period in which the reset pulse RESET is at the high level. Stated differently, the predetermined reset voltage Vreset may be applied from the data line 166 to the connection point between the anode electrode of the luminescence element 171 and the source electrode of the drive transistor TD by turning ON the first switching transistor T1 so that the reference voltage VR is supplied to the gate electrode of the drive transistor TD such that the drain current of the drive transistor TD is stopped, and by turning ON the second switching transistor T2 within the period in which the first switching transistor T1 is turned ON.

Furthermore, although the timing for switching the reset pulse RESET from the high level to the low level and the timing for switching the scanning pulse SCAN from the high level to the low level are simultaneous in t=T12 in FIG. 3 and t=T22 in FIG. 8, the advantageous effect of the present invention can be obtained as long as the scanning pulse SCAN is switched from the high level to the low level in the period in which the reset pulse RESET is at the high level. Stated differently, the predetermined reset voltage Vreset may be applied from the data line 166 to the connection point between the anode electrode of the luminescence element 171 and the source electrode of the drive transistor TD by turning ON the first switching transistor T1 so that the reference voltage VR is supplied to the gate electrode of the drive transistor TD such that the drain current of the drive transistor TD remains stopped, and by turning OFF the second switching transistor T2 within the period in which the first switching transistor T1 is turned ON.

Furthermore, although the timing for switching the reset pulse RESET from the low level to the high level and the timing for switching the scanning pulse SCAN from the low level to the high level are simultaneous in t=T13 in FIG. 3 and t=T24 in FIG. 8, the advantageous effect of the present invention can be obtained as long as the scanning pulse SCAN is switched from the low level to the high level in the period in which the reset pulse RESET is at the high level. Stated differently, the predetermined reset voltage Vreset may caused to be held in the capacitor C1 by turning ON the first switching transistor T1 so that the reference voltage VR is supplied to the gate electrode of the drive transistor TD such that the drain current of the drive transistor TD is stopped, and by turning ON the second switching transistor T2 within the period in which the first switching transistor T1 is turned ON such that the desired signal voltage Vdata is applied from the data line 166 to the second electrode of the capacitor C1.

Furthermore, although the timing for switching the reset pulse RESET from the high level to the low level and the timing for switching the scanning pulse SCAN from the high level to the low level is simultaneous in t=T14 in FIG. 3 and t=T24 in FIG. 8, the advantageous effect of the present invention can be obtained as long as the scanning pulse SCAN is switched from the high level to the low level in the period in which the reset pulse RESET is at the high level. Stated differently, the desired voltage VR−Vdata may caused to be held in the capacitor C1 by turning ON the first switching transistor T1 so that the reference voltage VR is supplied to the gate electrode of the drive transistor TD such that the drain current of the drive transistor TD remains stopped, and by turning ON the second switching transistor T2 within the period in which the first switching transistor T1 is turned ON such that the desired signal voltage Vdata is applied from the data line 166 to the second electrode of the capacitor C1.

Furthermore, the reset pulse RESET may be maintained at the high level in T11 to T14 and T21 to T25 in the timing charts in FIG. 3 and FIG. 8 so as to keep the first switching transistor in the ON state.

Furthermore, when the reset pulse reset and the scanning pulse SCAN are signals having exactly the same timing, the same polarity, and the same voltage value in FIG. 2 and FIG. 7, as in the timing charts in FIG. 3 and FIG. 8, respectively, they may be merged as one scanning signal. In other words, the reset line 161 and the scanning line 162 may be merged as one scanning line. With this, the number of scanning lines can be reduced, and thus the circuit configuration can be simplified.

Furthermore, the period in which the second switching transistor T2 is turned ON and the period in which it is turned OFF may be made common for predetermined luminescence pixels in the above-described embodiments. With this, the reset period and the data writing period can be shared among predetermined luminescence pixels. As such, a reset line 161 for controlling the first switching transistor T1 can be shared between predetermined luminescence pixels, and the number the number of the reset lines 161 for the display device as a whole can be reduced.

Furthermore, the period in which the third switching transistor T3 is turned ON and the period in which it is turned OFF may be made common for predetermined luminescence pixels in above-described Embodiment 2. Specifically, the period (luminescence producing period) in which the third switching transistor T3 is turned ON so as to connect the anode electrode of the luminescence element 171 and the second electrode of the capacitor C1 is shared by predetermined luminescence pixels. With this, a merge line 201 for controlling the third switching transistor T3 can be made common for predetermined luminescence pixels, and the number of merge lines 201 of the display device 200 can be reduced.

Figure 11:
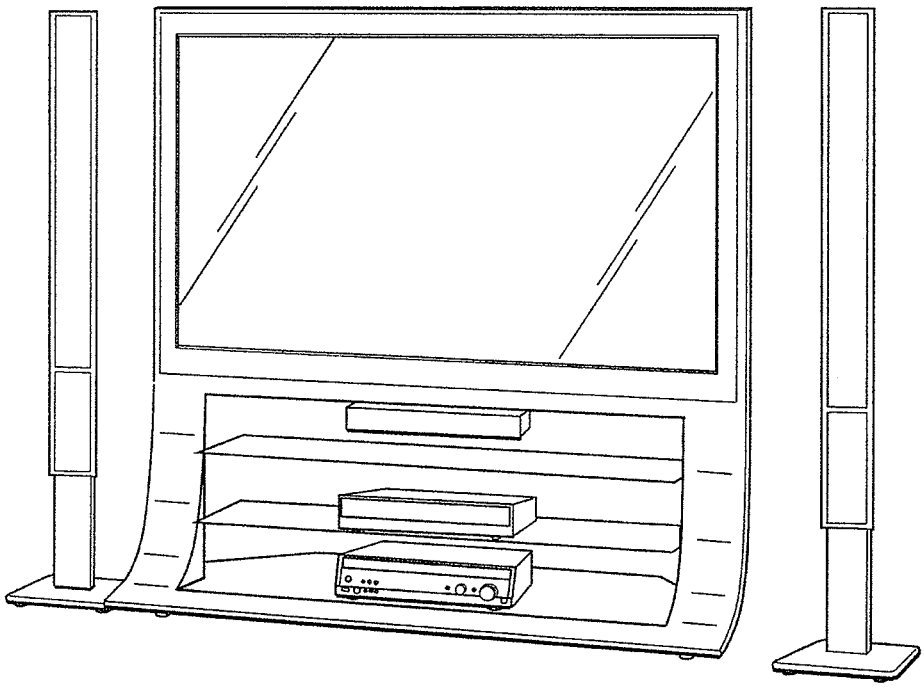
FIG. 11 is an outline view of a flat TV in which the display device in the present invention is built into.

Furthermore, for example, the display device in the present invention is built into a thin, flat TV shown in FIG. 11. A thin, flat TV capable of high-accuracy image display reflecting a video signal is implemented by having the image display device according to the present invention built into the TV.

Although only an exemplary embodiment of this invention has been described in detail above, those skilled in the art will readily appreciate that many modifications are possible in the exemplary embodiment without materially departing from the novel teachings and advantages of this invention. Accordingly, all such modifications are intended to be included within the scope of this invention.

INDUSTRIAL APPLICABILITY

The present invention is particularly useful in an active-type organic EL flat panel display which causes luminance to fluctuate by controlling pixel luminescence production intensity according to a pixel signal current.

What is claimed is:

1. A display device, comprising:

a luminescence element including a first electrode and a second electrode;

a capacitor which holds a voltage;

a driver which includes a gate electrode connected to a first electrode of the capacitor, and a source electrode connected to the first electrode of the luminescence element, and which supplies a drain current corresponding to the voltage held in the capacitor to the luminescence element so that the luminescence element produces luminescence;

a power source line for supplying a reference voltage which defines a voltage value of the gate electrode of the driver for placing the luminescence element in an OFF state;

a first switch which supplies the reference voltage to the gate electrode of the driver;

a data line for supplying a signal voltage and a predetermined reset voltage;

a second switch which includes one of terminals connected to the data line, and an other of the terminals connected to a second electrode of the capacitor, and which switches between conduction and non-conduction between the data line and the second electrode of the capacitor; and a drive circuit which controls the first switch and the second switch, wherein the drive circuit:

turns ON the first switch during a first portion of a reset period so that the reference voltage is supplied to the gate electrode of the driver and the luminescence element is placed in the OFF state;

turns ON the second switch during the first portion of the reset period in which the first switch is ON so that the predetermined reset voltage is applied from the data line to a connection point between the first electrode of the luminescence element and the source electrode of the driver;

turns OFF the first switch and the second switch during a second portion of the reset period after the first portion, after turning ON the second switch during the first portion of the reset period;

turns ON the first switch again during a write period different than the reset period after turning OFF the first switch and the second switch during the second portion of the rest period; and turns ON the second switch again during the write period in which the first switch is ON again so that the signal voltage is applied to the second electrode of the capacitor, and a predetermined voltage is thereby held in the capacitor.

2. The display device according to claim 1, wherein a timing for turning ON the first switch during the first portion of the rest period and a timing for turning ON the second switch during the first portion of the rest period are simultaneous.

3. The display device according to claim 1, wherein a timing for turning ON the first switch again during the write period and a timing for turning ON the second switch again during the write period are simultaneous.

4. The display device according to claim 1, wherein, after turning ON the second switch again during the write period so that the predetermined voltage is held in the capacitor, the drive circuit turns OFF the first switch and the second switch during a luminescence period.

5. The display device according to claim 1, further comprising a third switch provided in series between the first electrode of the luminescence element and the second electrode of the capacitor, wherein the drive circuit:

turns ON the second a switch again during the write period when the third switch is OFF, so as to apply the signal voltage to the second electrode of the capacitor so that the predetermined voltage is held in the capacitor;

turns OFF the first switch and the second switch during a luminescence period, after the predetermined voltage is held in the capacitor; and turns ON the third switch during the luminescence period.

6. The display device according to claim 5, wherein the luminescence element, the capacitor, the driver, the first switch, the second switch, and the third switch are included in a pixel circuit of a pixel, and the drive circuit:

sets, in common for predetermined pixels, a period in which the second switch is ON and a period in which the second switch is OFF, and sets, in common for the predetermined pixels, a period in which the third switch is ON and the write period in which the third switch is OFF.

7. The display device according to claim 5, wherein the luminescence element and the third switch are included in a pixel circuit of a pixel, and the pixel circuit includes plural pixel circuits arranged in a matrix.

8. The display device according to claim 5, wherein the luminescence element, the capacitor, the driver, the first switch, the second switch, and the third switch are included in a pixel circuit of a pixel, and the pixel circuit includes plural pixel circuits arranged in a matrix.

9. The display device according to claim 1, wherein the luminescence element, the capacitor, the driver, the first switch, and the second switch are included in a pixel circuit of a pixel, and the drive circuit sets, in common for predetermined pixels, a period in which the second switch is ON and a period in which the second switch is OFF.

10. The display device according to claim 1, wherein the first electrode of the luminescence element is an anode electrode, and the second electrode of the luminescence element is a cathode electrode.

11. The display device according to claim 1, further comprising:

a first scanning line for supplying a signal for controlling conduction and non-conduction of the first switch; and a second scanning line for supplying a signal for controlling conduction and non-conduction of the second switch, wherein the first scanning line and the second scanning line are a common scanning line.

12. The display device according to claim 1, wherein a voltage value of the predetermined reset voltage is set such that, when the predetermined reset voltage is applied from the data line to the connection point between the first electrode of the luminescence element and the source electrode of the driver, a potential difference between the gate electrode of the driver and the source electrode of the driver is a voltage that is lower than a threshold voltage with which the driver turns ON.

13. The display device according to claim 12, wherein the voltage value of the predetermined reset voltage is further set such that, when the predetermined reset voltage is applied from the data line to the connection point between the first electrode of the luminescence element and the source electrode of the driver, the potential difference between the first electrode of the luminescence element and the second electrode of the luminescence element is a voltage that is lower than a threshold voltage of the luminescence element with which the luminescence element starts to produce the luminescence.

14. The display device according to claim 1, wherein the luminescence element includes plural luminescence elements arranged in a matrix.

15. The display device according to claim 1, wherein the luminescence pixel is an organic electroluminescence luminescence element.

16. The display device according to claim 1, wherein a potential of the source electrode of the driver transitions to the predetermined reset voltage during the first portion of the reset period.

17. The display device according to claim 16, wherein the potential of the source electrode of the driver transitions to the predetermined reset voltage during the first portion of the reset period without being affected by a self-discharge time constant determined by a capacitive component of the luminescence element and a direct-current resistance component of the luminescence element.

18. The display device according to claim 16, wherein a potential of the gate electrode of the driver becomes the reference voltage at a substantially same time as when the potential of the source electrode of the driver transitions to the predetermined reset voltage.

19. The display device according to claim 16, wherein potentials of the gate electrode, the source electrode, and the drain electrode of the driver are all held approximately constant during the second portion of the reset period.

20. A method of controlling a display device, the display device including:

a luminescence element including a first electrode and a second electrode;

a capacitor which holds a voltage a driver which includes a gate electrode connected to a first electrode of the capacitor, and a source electrode connected to the first electrode of the luminescence element, and which supplies a drain current corresponding to the voltage held in the capacitor to the luminescence element so that the luminescence element produces luminescence;

a power source line for supplying a reference voltage which defines a voltage value of the gate electrode of the driver for placing the luminescence element in an OFF state;

a first switch which supplies the reference voltage to the gate electrode of the driver;

a data line for supplying a signal voltage and a predetermined reset voltage;

a second switch which includes one of terminals electrically connected to the data line, and an other of the terminals electrically connected to a second electrode of the capacitor, and which switches between conduction and non-conduction between the data line and the second electrode of the capacitor; and a drive circuit which controls the first switch and the second switch, the method comprising the following performed by the drive circuit:

turning ON the first switch during a first portion of a reset period so that the reference voltage is supplied to the gate electrode of the driver and the luminescence element is placed in the OFF state;

turning ON the second in a switch during the first portion of the reset period in which the first switch is ON so that the predetermined reset voltage is applied from the data line to a connection point between the first electrode of the luminescence element and the source electrode of the driver;

turning OFF the first switch and the second switch during a second portion of the reset period after the first portion, after turning ON the second switch during the first portion of the reset period, turning ON the first switch again during a write period different than the reset period after turning OFF the first switch and the second switch during the second portion of the rest period, and turning ON the second switch again during the write period in which the first switch is ON again so that the signal voltage is applied to the second electrode of the capacitor, and a predetermined voltage is thereby held in the capacitor.

* * * * *